US009890775B2

(12) United States Patent
Kim et al.

(10) Patent No.: US 9,890,775 B2
(45) Date of Patent: Feb. 13, 2018

(54) DISCHARGE VALVE COVER FOR A LINEAR COMPRESSOR HAVING A VALVE SPRING STOPPER AND DISCHARGE PULSATION REDUCING CHAMBERS

(71) Applicant: LG ELECTRONICS INC., Seoul (KR)

(72) Inventors: Junghae Kim, Seoul (KR); Kyoungkyu Lee, Seoul (KR); Kiwon Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 356 days.

(21) Appl. No.: 14/666,340

(22) Filed: Mar. 24, 2015

(65) Prior Publication Data

US 2016/0017876 A1 Jan. 21, 2016

(30) Foreign Application Priority Data

Jul. 21, 2014 (KR) ..... 10-2014-0091880

(51) Int. Cl.
*F04B 39/10* (2006.01)
*F04B 39/12* (2006.01)
(Continued)

(52) U.S. Cl.
CPC ..... *F04B 39/102* (2013.01); *F04B 35/045* (2013.01); *F04B 39/125* (2013.01); *F04B 53/1035* (2013.01); *F04B 2201/06062* (2013.01)

(58) Field of Classification Search
CPC ..... F04B 39/10; F04B 39/121; F04B 2201/06062; F04B 39/125; F04B 39/102;
(Continued)

(56) References Cited

U.S. PATENT DOCUMENTS 6,089,836 A * 7/2000 Seo ..... F04B 39/0005 417/415
2005/0092374 A1 5/2005 Kim et al.
(Continued)

FOREIGN PATENT DOCUMENTS

| | | |
|---|---|---|
| CN | 1458409 | 11/2003 |
| GB | 600125 | 4/1948 |
| KR | 10-2009-0044884 A | 5/2009 |

OTHER PUBLICATIONS

European Search Report dated Nov. 26, 2015, App. EP 15 16 4380.
Chinese Office Action dated Dec. 26, 2016, 100101.

*Primary Examiner* — Bryan Lettman
*Assistant Examiner* — Timothy Solak
(74) *Attorney, Agent, or Firm* — Ked & Associates LLP

(57) ABSTRACT

A linear compressor may include a shell, a cylinder provided in the shell to define a compression space for a refrigerant, a frame to fix the cylinder to the shell, a piston reciprocated within the cylinder, a discharge valve disposed on or at one side of the cylinder, a discharge cover coupled to the frame and having at least one chamber to reduce pulsation of the refrigerant discharged through the discharge valve, and a valve spring disposed on the discharge cover to provide a restoring force to the discharge valve. The discharge cover may include a cover body having a discharge hole, through which the refrigerant discharged through the discharge valve may be discharged outside of the discharge cover, and a guide passage defined in the cover body to guide at least a portion of the refrigerant discharged through the discharge valve into the at least one chamber.

15 Claims, 17 Drawing Sheets

(51) Int. Cl.
*F04B 53/10* (2006.01)
*F04B 35/04* (2006.01)

(58) Field of Classification Search
CPC ..... F04B 39/0027; F04B 39/0033; F04B 39/0066; F04B 39/1013; F04B 53/001; F04B 53/002; F04B 53/1022; F04B 53/1027; F04B 53/103; F04B 53/1035; F04B 53/1085; F04B 11/0091
See application file for complete search history.

(56) References Cited

U.S. PATENT DOCUMENTS

| | | | | |
|---|---|---|---|---|
| 2006/0076014 | A1* | 4/2006 | Jung | F04B 35/045 128/205.24 |
| 2006/0076015 | A1* | 4/2006 | Kim | F04B 39/102 128/205.24 |
| 2007/0295410 | A1* | 12/2007 | Choi | F04B 39/102 137/516.11 |
| 2009/0220365 | A1* | 9/2009 | Kang | F04B 39/102 417/570 |
| 2009/0277166 | A1 | 11/2009 | Walz | |
| 2010/0242721 | A1* | 9/2010 | Kim | F04B 35/045 92/261 |
| 2014/0105764 | A1 | 4/2014 | Lee et al. | |

* cited by examiner

DISCHARGE VALVE COVER FOR A LINEAR COMPRESSOR HAVING A VALVE SPRING STOPPER AND DISCHARGE PULSATION REDUCING CHAMBERS

CROSS-REFERENCE TO RELATED APPLICATION(S)

This application claims priority under 35 U.S.C. § 119 to Korean Application No. 10-2014-0091880 filed on Jul. 21, 2014, whose entire disclosure is hereby incorporated by reference.

BACKGROUND

1. Field

A linear compressor is disclosed herein.

2. Background

Cooling systems are systems in which a refrigerant is circulated to generate cool air. In such a cooling system, processes of compressing, condensing, expanding, and evaporating the refrigerant may be repeatedly performed. For this, the cooling system may include a compressor, a condenser, an expansion device, and an evaporator. The cooling system may be installed in a refrigerator or air conditioner, which is a home appliance.

In general, compressors are machines that receive power from a power generation device, such as an electric motor or turbine, to compress air, a refrigerant, or various working gases, thereby increasing in pressure. Compressors are being widely used in home appliances or industrial fields.

Compressors may be largely classified into reciprocating compressors, in which a compression space into and from which a working gas may be suctioned and discharged, is defined between a piston and a cylinder to allow the piston to be linearly reciprocated in the cylinder, thereby compressing the working gas; rotary compressors, in which a compression space into and from which a working gas is suctioned or discharged, is defined between a roller that eccentrically rotates and a cylinder to allow the roller to eccentrically rotate along an inner wall of the cylinder, thereby compressing the working gas; and scroll compressors, in which a compression space into and from which a working gas is suctioned or discharged, is defined between an orbiting scroll and a fixed scroll to compress the working gas while the orbiting scroll rotates along the fixed scroll. In recent years, a linear compressor which is directly connected to a drive motor, in which a piston is linearly reciprocated, to improve compression efficiency without mechanical losses due to movement conversion and has a simple structure, is being widely developed.

The linear compressor may suction and compress a working gas, such as a refrigerant, while a piston is linearly reciprocated in a sealed shell by a linear motor, and then, may discharge the working gas. The linear motor may include a permanent magnet between an inner stator and an outer stator. The permanent magnet may be linearly reciprocated by an electromagnetic force between the permanent magnet and the inner (or outer) stator. As the permanent magnet operates in a state in which the permanent magnet is connected to the piston, the refrigerant may be suctioned and compressed while the piston is linearly reciprocated within the cylinder, and then, may be discharged.

The present Applicant has a filed a patent (hereinafter, referred to as a "prior art document") and then registered the patent with respect to the linear compressor, as Korean Patent No. 10-1307688, filed on Sep. 5, 2013 and entitled "linear compressor", which is hereby incorporated by reference. The linear compressor according to the prior art document includes a shell that accommodates a plurality of components. A vertical height of the shell may be somewhat high, as illustrated in the prior art document. An oil supply assembly to supply oil between a cylinder and a piston may be disposed within the shell.

When the linear compressor is provided in a refrigerator, the linear compressor may be disposed in a machine chamber provided at a rear side of the refrigerator. In recent years, a major concern of customers is increasing an inner storage space of the refrigerator. To increase the inner storage space of the refrigerator, it may be necessary to reduce a volume of the machine room. To reduce the volume of the machine room, it may be important to reduce a size of the linear compressor.

However, as the linear compressor disclosed in the prior art document has a relatively large volume, the linear compressor is not applicable to a refrigerator, for which an increased inner storage space is sought. To reduce the size of the linear compressor, it may be necessary to reduce a size of a main component of the compressor. In this case, the compressor may deteriorate performance.

To compensate for the deteriorated performance of the compressor, it may be necessary to increase a drive frequency of the compressor. However, the more the drive frequency of the compressor is increased, the more a friction force due to oil circulating in the compressor increases, deteriorate in performance of the compressor.

Further, the prior art document discloses a feature in which a discharge valve spring that supports a discharge valve is provided as a coil spring. When the coil spring is applied to the discharge valve spring, the discharge valve may rotate with respect to the coil spring, causing abrasion of the discharge valve.

BRIEF DESCRIPTION OF THE DRAWINGS

Embodiments will be described in detail with reference to the following drawings in which like reference numerals refer to like elements, and wherein.

DETAILED DESCRIPTION

Hereinafter, exemplary embodiments will be described with reference to the accompanying drawings. The embodiments may, however, be embodied in many different forms and should not be construed as being limited to the embodiments set forth herein; rather, alternate embodiments within the spirit and scope will fully convey the concept to those skilled in the art.

Figure 1:
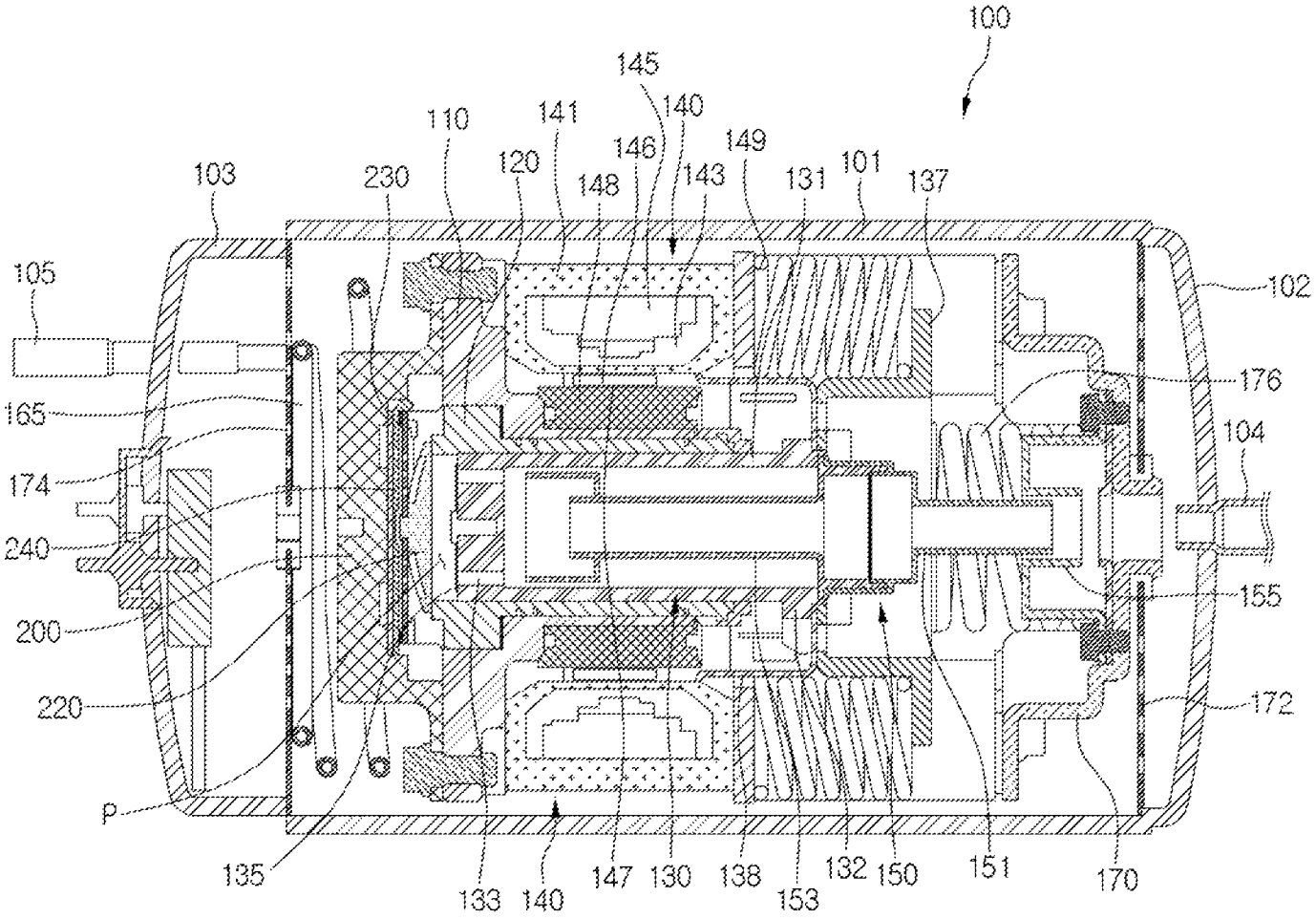
FIG. 1 is a cross-sectional view of a linear compressor according to an embodiment.

FIG. 1 is a cross-sectional view of a linear compressor according to an embodiment. Referring to FIG. 1, the linear compressor 100 according to this embodiment may include a shell 101 having an approximately cylindrical shape, a first cover 102 coupled to one or a first side of the shell 101, and a second cover 103 coupled to the other or a second side of the shell 101. For example, the linear compressor 100 may be laid out in a horizontal direction. In the linear compressor 100, the first cover 102 may be coupled to a right or first lateral side of the shell 101, and the second cover 103 may be coupled to a left or second lateral side of the shell 101. Each of the first and second covers 102 and 103 may be understood as one component of the shell 101.

The linear compressor 100 may further include a cylinder 120 provided in the shell 101, a piston 130 linearly reciprocated within the cylinder 120, and a motor assembly 140 that serves as a linear motor to apply a drive force to the piston 130. When the motor assembly 140 operates, the piston 130 may be linearly reciprocated at a high rate.

The linear compressor 100 according to this embodiment may have a drive frequency of about 100 Hz. The linear compressor 100 further include a suction inlet 104, through which the refrigerant may be introduced, and a discharge 105, through which the refrigerant compressed in the cylinder 120 may be discharged. The suction inlet 104 may be coupled to the first cover 102, and the discharge 105 may be coupled to the second cover 103.

The refrigerant suctioned in through the suction inlet 104 may flow into the piston 130 via a suction muffler 150. Thus, while the refrigerant passes through the suction muffler 150, noise may be reduced. The suction muffler 150 may be configured by coupling a first muffler 151 to a second muffler 153. At least a portion of the suction muffler 150 may be disposed within the piston 130.

The piston 130 may include a piston body 131 having an approximately cylindrical shape, and a piston flange 132 that extends from the piston body 131 in a radial direction. The piston body 131 may be reciprocated within the cylinder 120, and the piston flange 132 may be reciprocated outside of the cylinder 120.

The piston 130 may be formed of a non magnetic material, such as an aluminum material, such as aluminum or an aluminum alloy. As the piston 130 may be formed of the aluminum material, a magnetic flux generated in the motor assembly 140 may not be transmitted into the piston 130, and thus, may be prevented from leaking outside of the piston 130. The piston 130 may be manufactured by a forging process, for example.

The cylinder 120 may be formed of a non magnetic material, such as an aluminum material, such as aluminum or an aluminum alloy. Also, the cylinder 120 and the piston 130 may have a same material composition, that is, a same kind and composition.

As the cylinder 120 may formed of the aluminum material, a magnetic flux generated in the motor assembly 140 may not be transmitted into the cylinder 120, and thus, may be prevented from leaking outside of the piston 120. The cylinder 120 may be manufactured by an extruding rod processing process, for example.

Also, as the piston 130 is formed of the same material (aluminum) as the cylinder 120, the piston 130 may have a same thermal expansion coefficient as the cylinder 120. When the linear compressor 100 operates, a high-temperature (a temperature of about 100° C.) environment may be created within the shell 100. Thus, as the piston 130 and the cylinder 120 have the same thermal expansion coefficient, the piston 130 and the cylinder 120 may be thermally deformed by a same degree. As a result, the piston 130 and the cylinder 120 may be thermally deformed with sizes and in directions different from each other to prevent the piston 130 from interfering with the cylinder 120 while the piston 130 moves.

The cylinder 120 may accommodate at least a portion of the suction muffler 150 and at least a portion of the piston 130. The cylinder 120 may have a compression space P, in which the refrigerant may be compressed by the piston 130. A suction hole 133, through which the refrigerant may be introduced into the compression space P, may be defined in or at a front portion of the piston 130, and a suction valve 135 to selectively open the suction hole 133 may be disposed on or at a front side of the suction hole 133. A coupling hole, to which a predetermined coupling member may be coupled, may be defined in an approximately central portion of the suction valve 135.

A discharge cover 200 that defines a discharge space or discharge passage for the refrigerant discharged from the compression space P, and a discharge valve assembly 220, 230, 240 coupled to the discharge cover 200 to selectively discharge the refrigerant compressed in the compression space P may be provided at a front side of the compression space P. The discharge valve assembly 220, 230, 240 may include a discharge valve 220 to introduce the refrigerant into the discharge space of the discharge cover 200 when a pressure within the compression space P is above a predetermined discharge pressure, a valve spring 230 disposed between the discharge valve 220 and the discharge cover 200 to apply an elastic force in an axial direction, and a stopper 240 that restricts deformation of the valve spring 230.

The term "compression space P" may refer to a space defined between the suction valve 135 and the discharge valve 220. The suction valve 135 may be disposed on or at one or a first side of the compression space P, and the discharge valve 220 maybe disposed on or at the other or a second side of the compression space P, that is, a side opposite of the suction valve 135.

The term "axial direction" may refer to a direction in which the piston 130 is reciprocated, that is, a transverse direction in FIG. 1. Also, in the axial direction, a direction from the suction inlet 104 toward the discharge outlet 105, that is, a direction in which the refrigerant flows may be defined as a "frontward direction", and a direction opposite to the frontward direction may be defined as a "rearward direction". On the other hand, the term "radial direction" may refer to as a direction perpendicular to the direction in which the piston 130 is reciprocated, that is, a horizontal direction in FIG. 1.

The stopper 240 may be seated on the discharge cover 200, and the valve spring 230 may be seated at a rear side of the stopper 240. Also, the discharge valve 220 may be coupled to the valve spring 230, and a rear portion or rear surface of the discharge valve 220 may be supported by a front surface of the cylinder 120. The valve spring 230 may include a plate spring, for example.

While the piston 130 is linearly reciprocated within the cylinder 120, when the pressure of the compression space P is below the predetermined discharge pressure and a predetermined suction pressure, the suction valve 135 may be opened to suction the refrigerant into the compression space P. On the other hand, when the pressure of the compression space P is above the predetermined suction pressure, the refrigerant in the compression space P may be compressed in a state in which the suction valve 135 is closed.

When the pressure of the compression space P is above the predetermined discharge pressure, the valve spring 230 may be deformed to open the discharge valve 220. The refrigerant may be discharged from the compression space P into the discharge space of the discharge cover 200. When the discharge of the refrigerant is completed, the valve spring 230 may provide a restoring force to the discharge valve 220 to close the discharge valve 220.

The refrigerant flowing into the discharge space of the discharge cover 200 may be introduced into a bop pipe 165. The loop pipe 165 may be coupled to the discharge cover 200 to extend to the discharge outlet 105, thereby guiding the compressed refrigerant in the discharge space into the discharge outlet 105. For example, the loop pipe 165 may have a shape that is wound in a predetermined direction and extends in a rounded shape. The loop pipe 165 may be coupled to the discharge outlet 105.

The linear compressor 100 may further include a frame 110. The frame 110 may fix the cylinder 120 and be coupled to the cylinder 120 by a separate coupling member, for example. The frame 110 may surround the cylinder 120. That is, the cylinder 120 may be accommodated within the frame 110. Also, the discharge cover 200 may be coupled to a front surface of the frame 110.

At least a portion of the high-pressure gas refrigerant discharged through the opened discharge valve 220 may flow toward an outer circumferential surface of the cylinder 120 through a space at a portion at which the cylinder 120 and the frame 110 are coupled to each other. The refrigerant may be introduced into the cylinder 120 through one or more gas inflows (see reference numeral 122 of FIG. 7) and one or more nozzle (see reference numeral 123 of FIG. 7), which may be defined in the cylinder 120. The introduced refrigerant may flow into a space defined between the piston 130 and the cylinder 120 to allow an outer circumferential surface of the piston 130 to be spaced apart from an inner circumferential surface of the cylinder 120. Thus, the introduced refrigerant may serve as a "gas bearing" that reduces friction between the piston 130 and the cylinder 120 while the piston 200 is reciprocated. That is, in this embodiment, a bearing using oil is not applied.

The motor assembly 140 may include outer stators 141, 143, and 145 fixed to the frame 110 and disposed to surround the cylinder 120, an inner stator 148 disposed to be spaced inward from the outer stators 141, 143, and 145, and a permanent magnet 146 disposed in a space between the outer stators 141, 143, and 145 and the inner stator 148. The permanent magnet 146 may be linearly reciprocated by a mutual electromagnetic force between the outer stators 141, 143, and 145 and the inner stator 148. The permanent magnet 146 may be provided as a single magnet having one polarity, or a plurality of magnets having three polarities.

The permanent magnet 146 may be coupled to the piston 130 by a connection member 138, for example. In detail, the connection member 138 may be coupled to the piston flange 132 and be bent to extend toward the permanent magnet 146. As the permanent magnet 146 is reciprocated, the piston 130 may be reciprocated together with the permanent magnet 146 in the axial direction.

The motor assembly 140 may further include a fixing member 147 to fix the permanent magnet 146 to the connection member 138. The fixing member 147 may be formed of a composition in which a glass fiber or carbon fiber is mixed with a resin. The fixing member 147 may be provided to surround an outside of the permanent magnet 146 to firmly maintain the coupled state between the permanent magnet 146 and the connection member 138.

The outer stators 141, 143, and 145 may include coil winding bodies 143 and 145, and a stator core 141. The coil winding bodies 143 and 145 may include a bobbin 143, and a coil 145 wound in a circumferential direction of the bobbin 143. The coil 145 may have a polygonal cross-section, for example, a hexagonal cross-section. The stator core 141 may be manufactured by stacking a plurality of laminations in a circumferential direction and be disposed to surround the coil winding bodies 143 and 145.

A stator cover 149 may be disposed on or at one side of the outer stators 141, 143, and 145. One or a first side of the outer stators 141, 143, and 145 may be supported by the frame 110, and the other or a second side of the outer stators 141, 143, and 145 may be supported by the stator cover 149.

The inner stator 148 may be fixed to a circumference of the frame 110. Also, in the inner stator 148, a plurality of laminations may be stacked in a circumferential direction outside of the frame 110.

The linear compressor 100 may further include a support 137 that supports the piston 130, and a back cover 170 spring-coupled to the support 137. The support 137 may be coupled to the piston flange 132 and the connection member 138 by a predetermined coupling member, for example.

A suction guide 155 may be coupled to a front portion of the back cover 170. The suction guide 155 may guide the refrigerant suctioned through the suction inlet 104 to introduce the refrigerant into the suction muffler 150.

The linear compressor 100 may include a plurality of springs 176, which are adjustable in natural frequency, to allow the piston 130 to perform a resonant motion. The plurality of springs 176 may include a first spring supported between the support 137 and the stator cover 149, and a second spring supported between the support 137 and the back cover 170.

The linear compressor 100 may further include plate springs 172 and 174, respectively, disposed on both lateral sides of the shell 101 to allow inner components of the compressor 100 to be supported by the shell 101. The plate springs 172 and 174 may include a first plate spring 172 coupled to the first cover 102, and a second plate spring 174 coupled to the second cover 103. For example, the first plate spring 172 may be fitted into a portion at which the shell 101 and the first cover 102 are coupled to each other, and the second plate spring 174 may be fitted into a portion at which the shell 101 and the second cover 103 are coupled to each other.

Figure 2:
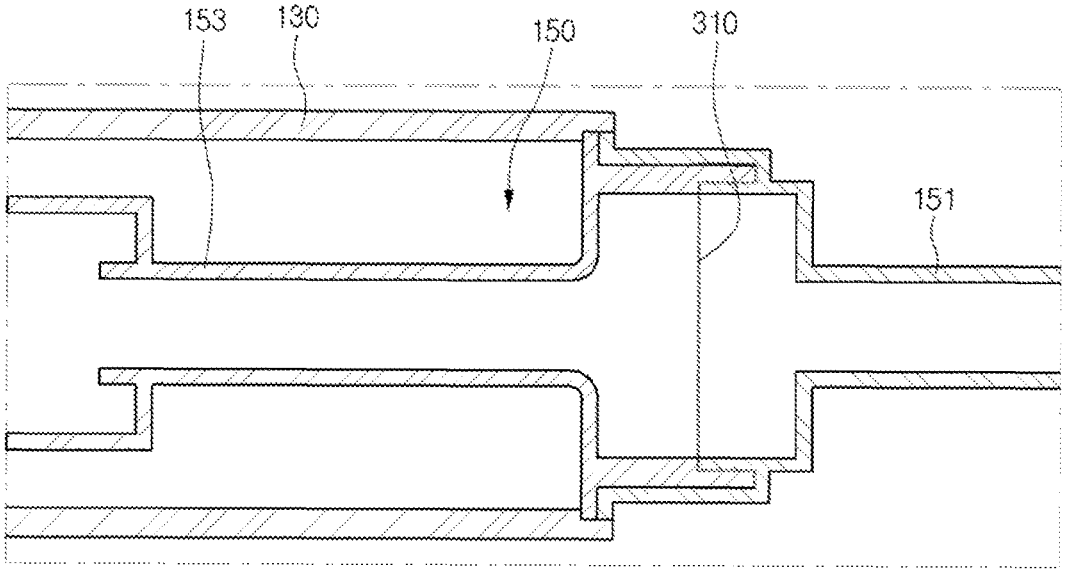
FIG. 2 is a cross-sectional view of a suction muffler according to an embodiment.

FIG. 2 is a cross-sectional view illustrating a configuration of a suction muffler according to an embodiment. Referring to FIG. 2, the suction muffler 150 according to this embodiment may include the first muffler 151, the second muffler 153 coupled to the first muffler 151, and a first filter 310 supported by the first and second mufflers 151 and 153.

A flow space, in which the refrigerant may flow, may be defined in each of the first and second mufflers 151 and 153. The first muffler 151 may extend from an inside of the suction inlet 104 in a direction of the discharge outlet 105, and at least a portion of the first muffler 151 may extend to an inside of the suction guide 155. The second muffler 153 may extend from the first muffler 151 to an inside of the piston body 131.

The first filter 310 may be disposed in the flow space to filter foreign substances. The first filter 310 may be formed of a material having a magnetic property. Thus, foreign substances contained in the refrigerant, in particular, metallic substances, may be easily filtered. For example, the first filter 310 may be formed of stainless steel, for example, and thus, the first filter 310 may have a magnetic property to prevent the first filter 310 from rusting. As another example, the first filter 310 may be coated with a magnetic material, or a magnet may be attached to a surface of the first filter 310.

The first filter 310 may be a mesh-type structure and have an approximately circular plate shape. Each filter hole of the first filter 310 may have a diameter or width less than a predetermined diameter or width. For example, the predetermined size may be about 25 μm.

The first muffler 151 and the second muffler 153 may be assembled with each other using a press-fit manner, for example. The first filter 310 may be fitted into a portion at which the first and second mufflers 151 and 153 are coupled to or press-fitted together, and then, may be assembled.

For example, a groove may be defined in one of the first muffler 151 or the second muffler 153, and a protrusion inserted into the groove may be disposed on the other one of the first muffler 151 or the second muffler 153. The first filter 310 may be supported by the first and second mufflers 151 and 153 in a state in which both sides of the first filter 310 are disposed between the groove and the protrusion.

In a state in which the first filter 310 is disposed between the first and second mufflers 151 and 153, when the first and second mufflers 151 and 153 move in a direction that approach each other and then are coupled to or press-fitted, both sides of the first filter 310 may be inserted and fixed between the groove and the protrusion.

As described above, as the first filter 310 is provided on the suction muffler 150, a foreign substance having a size greater than a predetermined size of the refrigerant suctioned through the suction inlet 104 may be filtered by the first filter 310. Thus, the first filter 310 may filter the foreign substance from the refrigerant acting as the gas bearing between the piston 130 and the cylinder 120 to prevent the foreign substance from being introduced into the cylinder 120. Also, as the first filter 310 is firmly fixed to the portion at which the first and second mufflers 151 and 153 are press-fitted, separation of the first filter 310 from the suction muffler 150 may be prevented.

Figure 3:
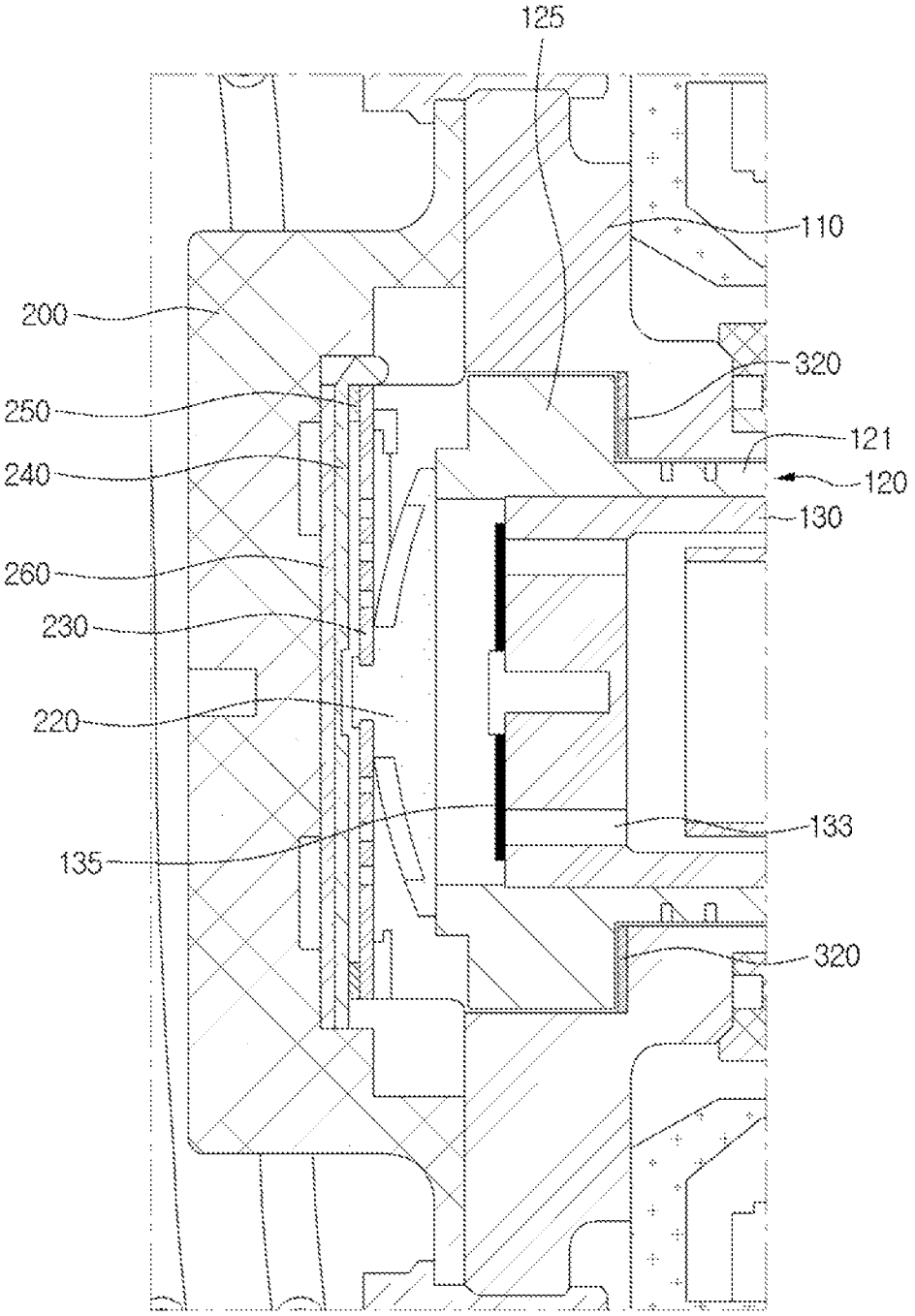
FIG. 3 is a cross-sectional view of a discharge cover and a discharge valve according to an embodiment.
Figure 4:
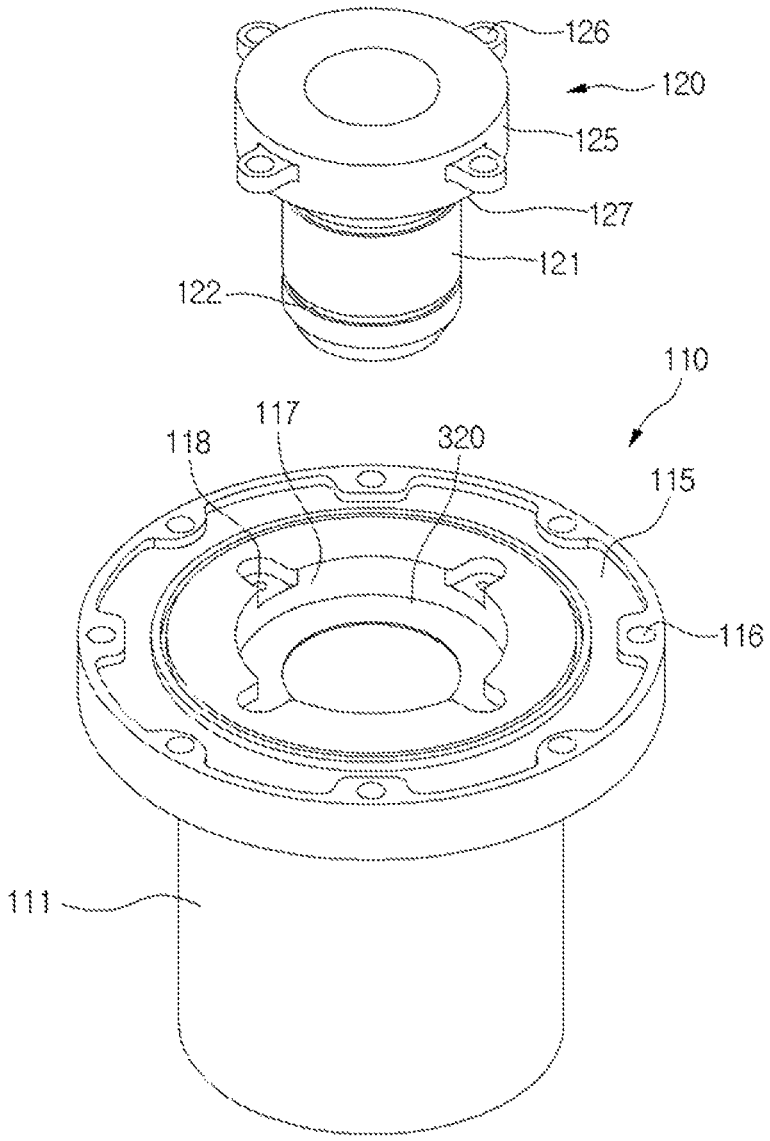
FIG. 4 is an exploded perspective view of a cylinder and a frame according to an embodiment.

FIG. 3 is a cross-sectional view of a discharge cover and a discharge valve according to an embodiment. FIG. 4 is an exploded perspective view of a cylinder and a frame according to an embodiment.

Referring to FIGS. 3 and 4, the linear compressor 100 according to this embodiment may include the discharge valve 220 selectively opened to discharge the refrigerant compressed in the compression space P. A rear surface of the discharge valve 220 may be disposed to contact a front portion of the cylinder 120. In a state in which the rear surface of the discharge valve 220 contacts the front portion of the cylinder 120, the refrigerant within the compression space P may be compressed. When a pressure in the compression space P is above the predetermined discharge pressure, the rear surface of the predetermined discharge valve 220 may be spaced apart from the front portion of the cylinder 120 to open the discharge valve 220. Thus, the compressed refrigerant may be discharged through the space.

The linear compressor 100 may further include the valve spring 230 coupled to the front portion of the discharge valve 220 to elastically support the discharge valve 220, and the stopper 240 to restrict deformation of the valve spring 230 to a preset or predetermined degree or less. When the discharge valve 220 is opened, the valve spring 230 may be deformed forward. In this way, the stopper 240 may interfere with the valve spring 230 at a front side of the valve spring 230 to prevent the valve spring 230 from being excessively deformed.

The linear compressor 100 may include a plurality of spacers 250 and 260, respectively, disposed on or at first and second sides of the stopper 240. The plurality of spacers 250 and 260 may include a first spacer 250 disposed between the valve spring 230 and the stopper 240, and a second spacer 260 disposed at the front side of the valve spring 230.

The first spacer 250 may space the valve spring 230 from the stopper 240 by a preset or predetermined distance to secure a space in which the valve spring 230 may be deformed. The preset or predetermined distance may be determined by an adjustable thickness of the first spacer 250.

The second spacer 260 may be disposed between the stopper 240 and the discharge cover 200 to stably support the stopper 240 on the discharge cover 220. Thus, when a repetitive impact occurs between the valve spring 230 and the stopper 240, damage to the stopper 240 by the discharge cover 200, in particular, a phenomenon that occurs when the discharge cover 200 has a hardness greater than a hardness of the stopper 240 may be prevented.

The linear compressor 100 may include a second filter 320 disposed between the frame 110 and the cylinder 120 to filter a high-pressure gas refrigerant discharged through the discharge valve 220. The second filter 320 may be disposed on or at a portion of a coupled surface on or at which the frame 110 and the cylinder 120 are coupled to each other.

The cylinder 120 may include a cylinder body 121 having an approximately cylindrical shape, and a cylinder flange 125 that extends from the cylinder body 121 in a radial direction. The cylinder body 121 may include a gas inflow 122, through which the discharged gas refrigerant may be introduced. The gas inflow 122 may be recessed in an approximately circular shape along a circumferential surface of the cylinder body 121.

A plurality of the gas inflow 122 may be provided. The plurality of gas inflows 122 may include gas inflows (see reference numerals 122*a* and 122*b* of FIG. 6) disposed on or at one or a first side with respect to a center or central portion 121*c* of the cylinder body 121 in an axial direction, and a gas inflow (see reference numeral 122*c* of FIG. 6) disposed on or at the other or a second side with respect to the center or central portion 121*c* of the cylinder body 121 in the axial direction.

One or more coupling portion 126 coupled to the frame 110 may be disposed on the cylinder flange 125. Each coupling portion 126 may protrude outward from an outer circumferential surface of the cylinder flange 125, and be coupled to a cylinder coupling hole 118 of the frame 110 by a predetermined coupling member, for example.

The cylinder flange 125 may have a seat surface 127 seated on the frame 110. The seat surface 127 may be a rear surface of the cylinder flange 125 that extends from the cylinder body 121 in the radial direction.

The frame 110 may include a frame body 111 that surrounds the cylinder body 121, and a cover coupling portion 115 that extends in a radial direction of the frame body 111 and is coupled to the discharge cover 200. The cover coupling portion 115 may include a plurality of the cover coupling holes 116, in which the coupling member coupled to the discharge cover 200 may be inserted, and a plurality of the cylinder coupling holes 118, in which the coupling member coupled to the cylinder flange 125 may be inserted. The cylinder coupling holes 118 may be defined in or at positions recessed somewhat from the cover coupling portion 115.

The frame 110 may have a recess 117 recessed backward from the cover coupling portion 115 to allow the cylinder flange 125 to be inserted therein. That is, the recess 117 may be disposed to surround an outer circumferential surface of the cylinder flange 125. The recess 117 may have a recessed depth corresponding to a front/rear width of the cylinder flange 125.

A predetermined refrigerant flow space may be defined between an inner circumferential surface of the recess 117 and the outer circumferential surface of the cylinder flange 125. The high-pressure gas refrigerant discharged from the discharge valve 220 may flow toward the outer circumferential surface of the cylinder body 121 via the refrigerant flow space. The second filter 320 may be disposed in the refrigerant flow space to filter the refrigerant.

In detail, a seat having a stepped portion may be disposed on or at a rear end of the recess 117. The second filter 320 having a ring shape may be seated on the seat.

In a state in which the second filter 320 is seated on the seat, when the cylinder 120 is coupled to the frame 110, the cylinder flange 125 may push the second filter 320 from a front side of the second filter 320. That is, the second filter 320 may be disposed and fixed between the seat of the frame 110 and the seat surface 127 of the cylinder flange 125.

The second filter 320 may prevent foreign substances in the high-pressure gas refrigerant discharged through the opened discharge valve 220 from being introduced into the gas inflow 122 of the cylinder 120 and absorb oil contained in the refrigerant. For example, the second filter 320 may include a felt formed of polyethylene terephthalate (PET) fiber or an absorbent paper. The PET fiber may have superior heat-resistance and mechanical strength. Also, a foreign substance having a size of about 2 μm or more, which is contained in the refrigerant, may be blocked.

The high-pressure gas refrigerant passing through the flow space defined between the inner circumferential surface of the recess 117 and the outer circumferential surface of the cylinder flange 125 may pass through the second filter 320. In this way, the refrigerant may be filtered by the second filter 320.

Figure 5:
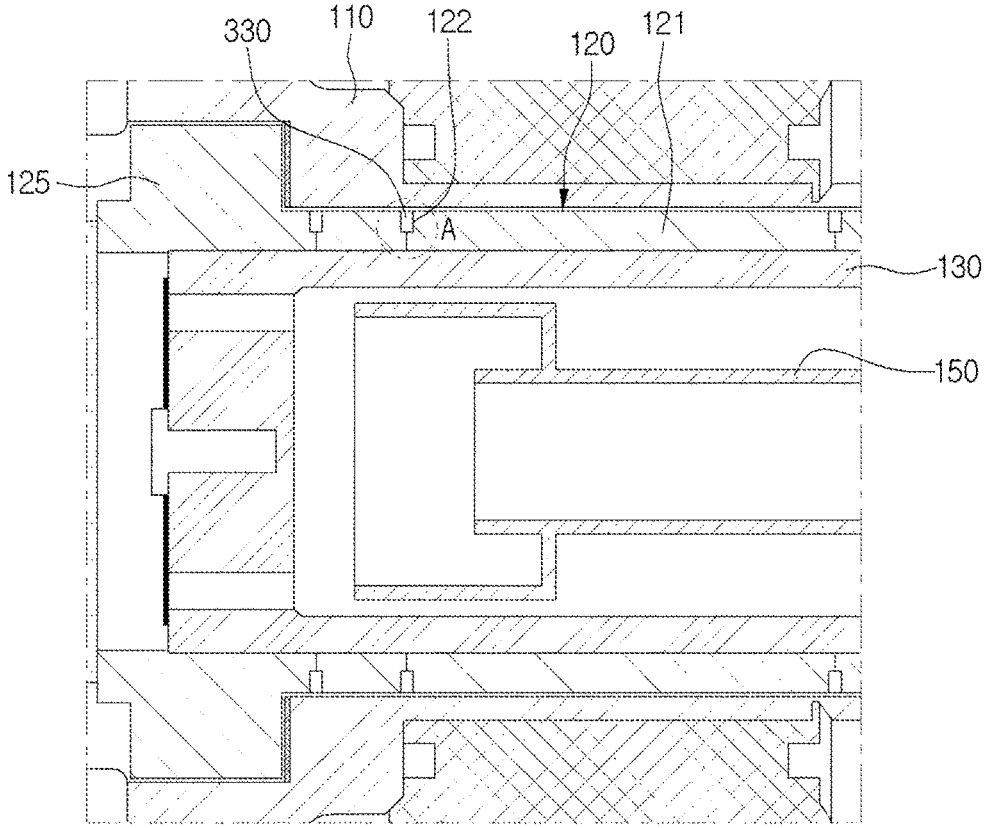
FIG. 5 is a cross-sectional view illustrating a state in which the cylinder and a piston are coupled to each other according to an embodiment.
Figure 6:
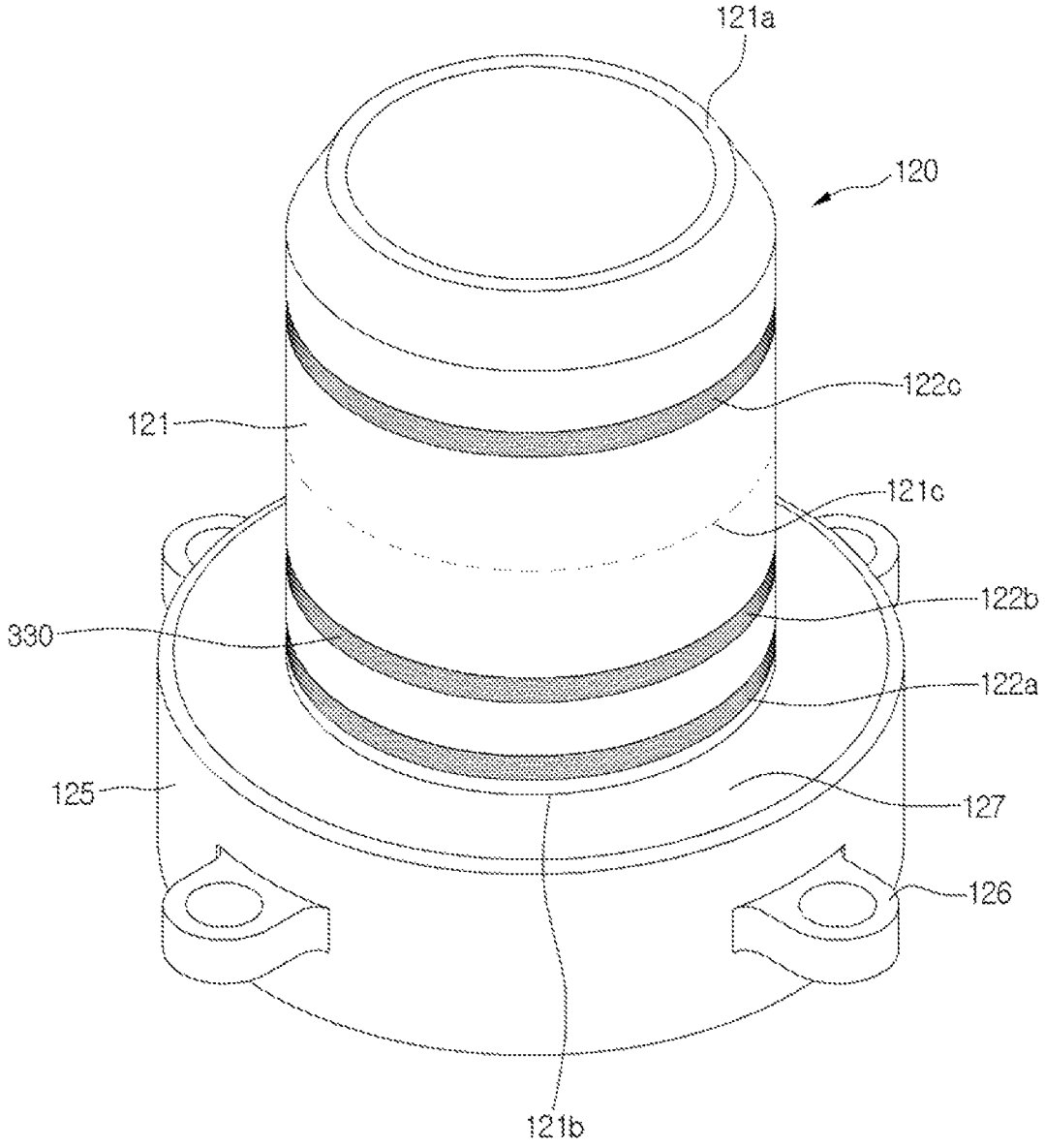
FIG. 6 is an exploded perspective view of the cylinder according to an embodiment.
Figure 7:
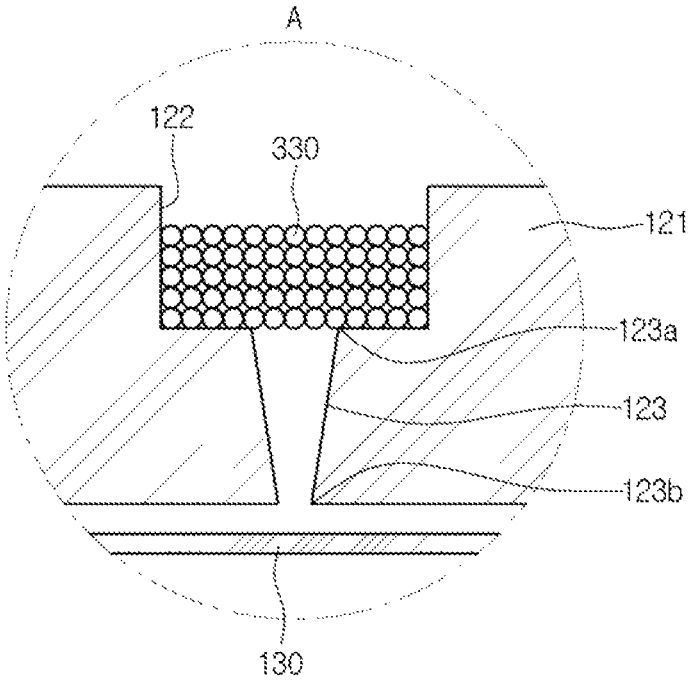
FIG. 7 is an enlarged cross-sectional view of portion A of FIG. 5.

FIG. 5 is a cross-sectional view illustrating a state in which the cylinder and a piston are coupled to each other according to an embodiment. FIG. 6 is an exploded perspective view of the cylinder according to an embodiment. FIG. 7 is an enlarged cross-sectional view of portion A of FIG. 5.

Referring to FIGS. 5 to 7, the cylinder 120 according to this embodiment may include the cylinder body 121 having an approximately cylindrical shape to form a first body end 121*a* and a second body end 121*b*, and the cylinder flange 125 that extends from the second body end 121*b* of the cylinder body 121 in the radial direction. The first body end 121*a* and the second body end 121*b* may form both ends of the cylinder body 121 with respect to the central portion 121*c* of the cylinder body 121 in the axial direction.

The cylinder body 121 may include the plurality of gas inflows 122, through which at least a portion of the high-pressure gas refrigerant discharged through the discharge valve 220 may flow. A third filter 330 as a "filter member" may be disposed in the plurality of gas inflows 122.

Each of the plurality of gas inflows 122 may be recessed from the outer circumferential surface of the cylinder body 121 by a predetermined depth and width. The refrigerant may be introduced into the cylinder body 121 through the plurality of gas inflows 122 and the nozzle 123.

The introduced refrigerant may be disposed between the outer circumferential surface of the piston 130 and the inner circumferential surface of the cylinder 120 to serve as the gas bearing with respect to movement of the piston 130. That is, the outer circumferential surface of the piston 130 may be maintained in a state in which the outer circumferential surface of the piston 130 is spaced apart from the inner circumferential surface of the cylinder 120 by a pressure of the introduced refrigerant.

The plurality of gas inflows 122 may include the first and second gas inflows 122*a* disposed on or at one or the first side with respect to the central portion 121*c* in the axial direction of the cylinder body 121, and the third gas inflow 122*c* disposed on or at the other or a second side with respect to the central portion 121*c* in the axial direction.

The first and second gas inflows 122*a* and 122*b* may be disposed at positions closer to the second body end 121*b* with respect to the central portion 121*c* in the axial direction of the cylinder body 121, and the third gas inflow 122*c* may be disposed at a position closer to the first body end 121*a* with respect to the central portion 121*c* in the axial direction of the cylinder body 121. That is, the plurality of gas inflows 122 may be provided in numbers which are not symmetrical to each other with respect to the central portion 121*c* in the axial direction of the cylinder body 121.

Referring to FIG. 6, the cylinder 120 may have a relatively high inner pressure at a side of the second body end 121*b*, which may be closer to a discharge-side of the compressed refrigerant when compared to that of the first body end 121*a*, which may be closer to a suction-side of the refrigerant. Thus, more gas inflows 122 may be provided at the side of the second body end 121*b* to enhance the function of the gas bearing, and relatively less gas inflows 122 may be provided at the side of the first body end 121*a*.

The cylinder body 121 may further include the nozzle 123 that extends from the plurality of gas inflows 122 toward the inner circumferential surface of the cylinder body 121. Each nozzle 123 may have a width or size less than a width or size of the gas inflow 122.

A plurality of the nozzle 123 may be provided along the gas inflow 122, which may extend in a circular shape. The plurality of nozzles 123 may be disposed to be spaced apart from each other.

Each nozzle 123 may include an inlet 123*a* connected to the gas inflow 122, and an outlet 123*b* connected to the inner circumferential surface of the cylinder body 121. The nozzle 123 may have a predetermined length from the inlet 123*a* to the outlet 123*b*.

The refrigerant introduced into the gas inflow 122 may be filtered by the third filter 330 to flow into the inlet 123*a* of the nozzle 123 and then flow toward the inner circumferential surface of the cylinder 120 along the nozzle 123. The refrigerant may be introduced into an inner space of the cylinder 120 through the outlet 123*b*.

The piston 130 may operate spaced apart from the inner circumferential surface of the cylinder 120, that is, be lifted from the inner circumferential surface of the cylinder 120 by the pressure of the refrigerant discharged from the outlet 123*b*. That is, the pressure of the refrigerant supplied into the cylinder 120 may provide a lifting force or pressure to the piston 130.

A recessed depth and width of each of the plurality of gas inflows 122, and a length L of the nozzle 123 may be determined to have adequate dimensions in consideration of a rigidity of the cylinder 120, an amount of third filter 330, or an intensity in pressure drop of the refrigerant passing through the nozzle 123. For example, if the recessed depth and width of each of the plurality of gas inflows 122 are very large, or the length of the nozzle 123 is very short, the rigidity of the cylinder 120 may be weak. On the other hand, if the recessed depth and width of each of the plurality of gas inflows 122 are too small, an amount of the third filter 330 provided in the gas inflow 122 may be too small. Also, if the length of the nozzle 123 is too long, a pressure drop of the refrigerant passing through the nozzle 123 may be too large, and it may be difficult to perform the function as the gas bearing.

The inlet 123*a* of the nozzle 123 may have a diameter greater than a diameter of the outlet 123*b*. In the flow direction of the refrigerant, a flow section area of the nozzle 123 may gradually decrease from the inlet 123*a* to the outlet 123*b*.

In detail, if the diameter of the nozzle 123 is too small, an amount of refrigerant, which is introduced from the nozzle 123, of the high-pressure gas refrigerant discharged through the discharge valve 220 may be too large, increasing flow loss in the compressor. On the other hand, if the diameter of the nozzle 123 is too small, the pressure drop in the nozzle 123 may increase, reducing the performance of the gas bearing.

Thus, in this embodiment, the inlet 123*a* of the nozzle 123 may have a relatively large diameter to reduce the pressure drop of the refrigerant introduced into the nozzle 123. In addition, the outlet 123*b* may have a relatively small diameter to control an inflow amount of gas bearing through the nozzle 123 to a predetermined value or less.

The third filter 330 may prevent a foreign substance having a predetermined size or more from being introduced into the cylinder 120 and perform a function to absorb oil contained in the refrigerant. The predetermined size may be about 1 μm, for example.

The third filter 330 may include a thread wound around the gas inflow 122. The thread may be formed of a polyethylene terephthalate (PET) material and have a predetermined thickness or diameter.

A thickness or diameter of the thread may be determined to have adequate dimensions in consideration of a rigidity of a thread. If the thickness or diameter of the thread is too small, the thread may be easily broken due to a very weak strength thereof. On the other hand, if the thickness or diameter of the thread is too large, a filtering effect with respect to foreign substances may be deteriorated due to a very large pore in the gas inflow 122 when the thread is wound.

For example, the thickness or diameter of the thread may be several hundreds μm. The thread may be manufactured by coupling a plurality of strands of a spun thread having several tens μm to each other, for example.

The thread may be wound several times, and an end of the thread may be fixed through or by a knot. A number of windings of the thread may be adequately selected in consideration of a pressure drop of the gas refrigerant and the filtering effect with respect to foreign substances. If the number of thread windings is too large, the pressure drop of the gas refrigerant may increase. On the other hand, if the number of thread windings is too small, the filtering effect with respect to the foreign substances may be reduced.

Also, a tension force of the wound thread may be adequately controlled in consideration of a strain of the cylinder 120 and fixation of the thread. If the tension force is too large, deformation of the cylinder 120 may occur. On the other hand, if the tension force is too small, the thread may not be well fixed to the gas inflow 122.

Figure 8:
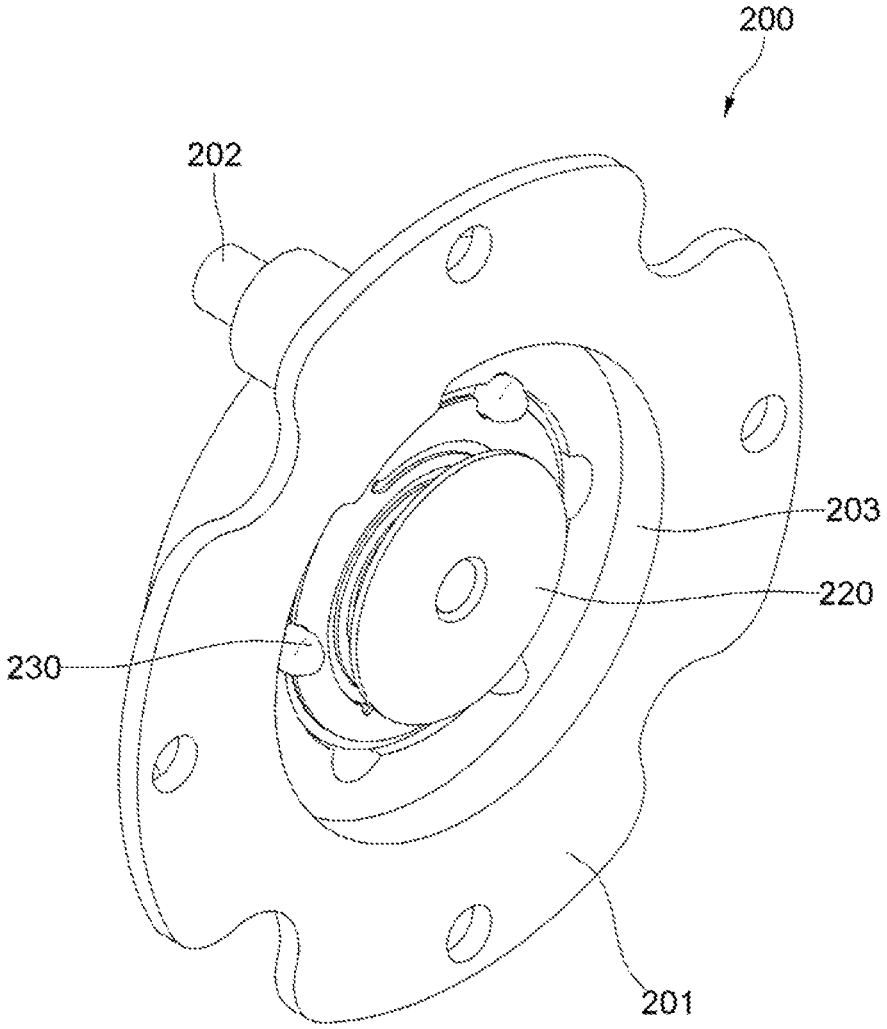
FIG. 8 is a perspective view of a discharge valve assembly coupled to the discharge cover according to an embodiment.
Figure 9:
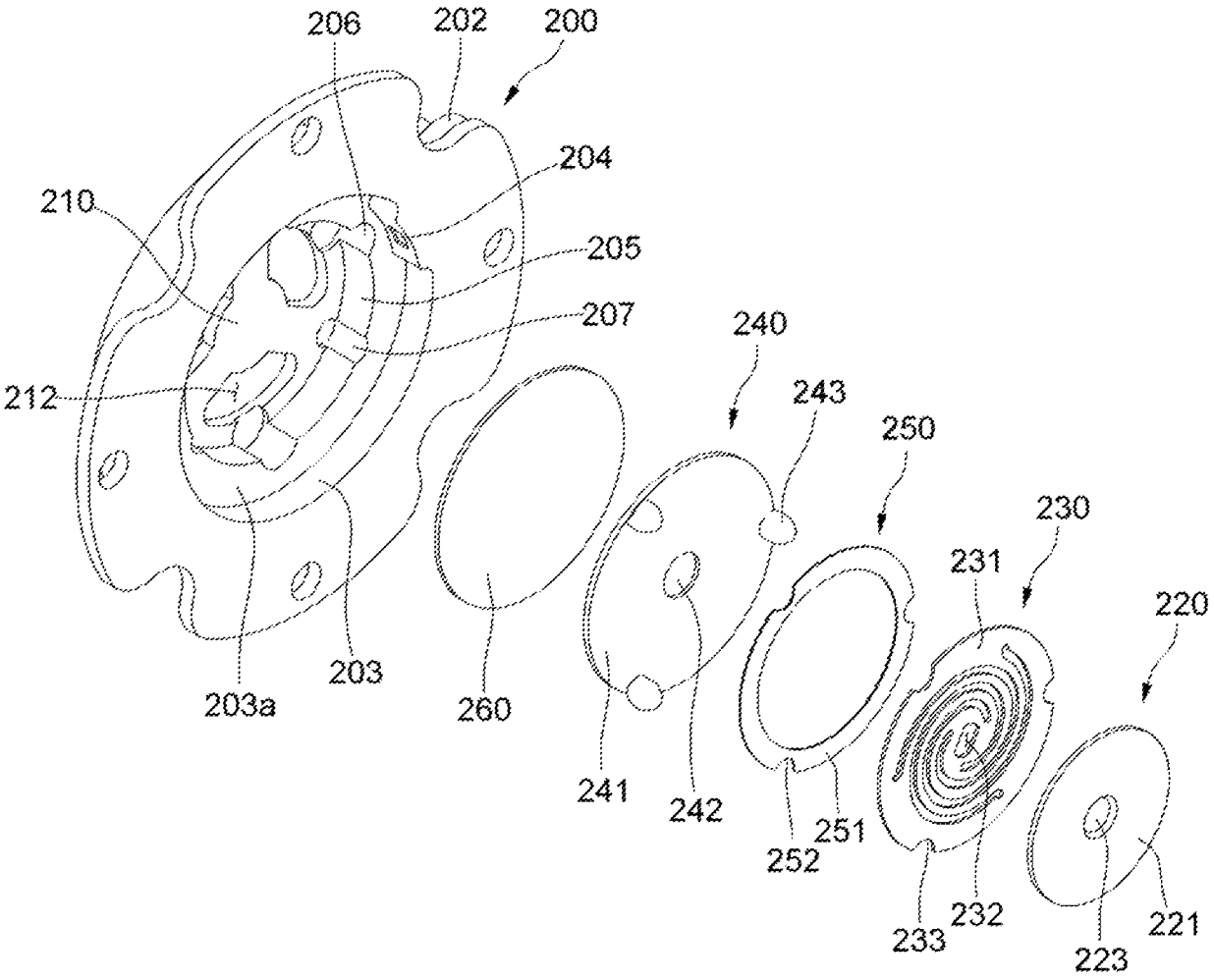
FIG. 9 is an exploded perspective view of the discharge cover and the discharge valve assembly of FIG. 8.
Figure 10:
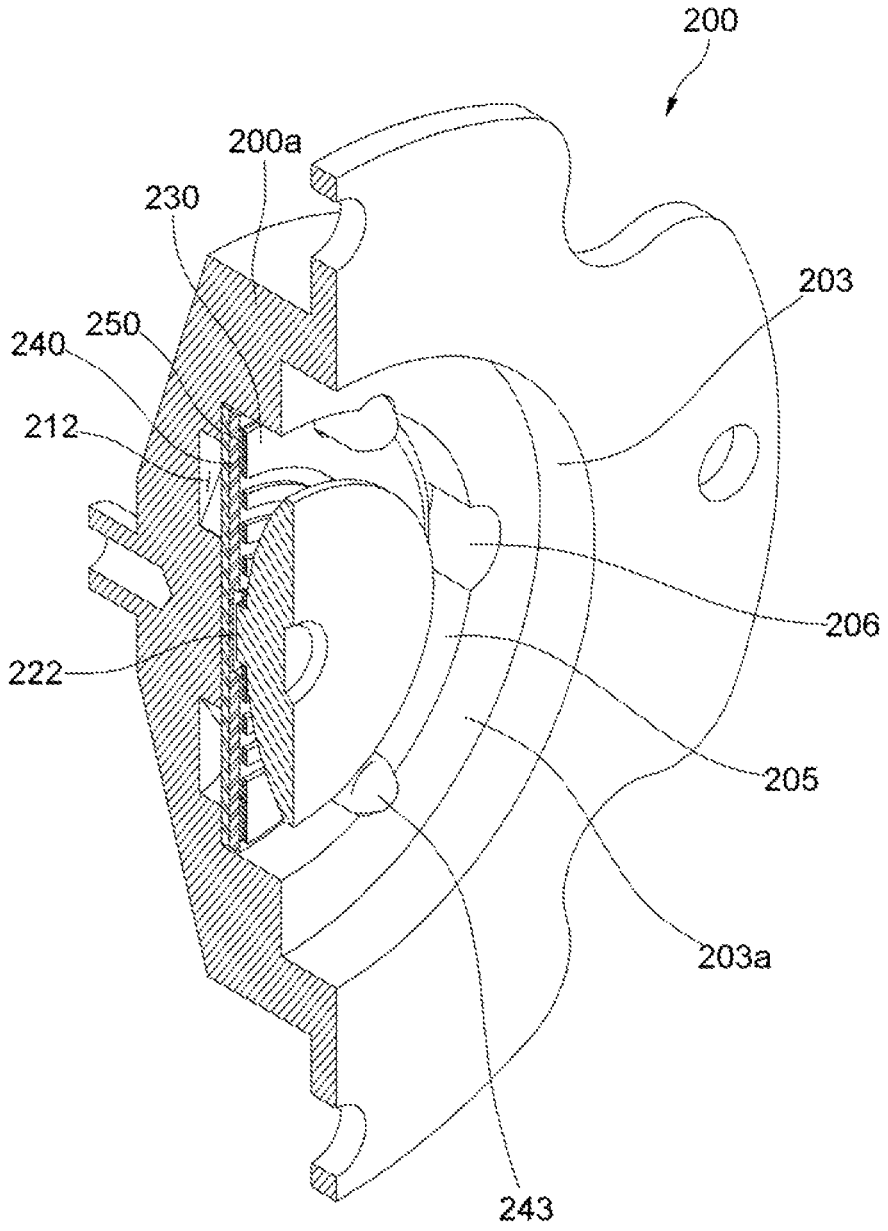
FIG. 10 is a cross-sectional view of the discharge cover and the discharge valve assembly of FIG. 8.

FIG. 8 is a perspective view of a discharge valve assembly coupled to the discharge cover according to an embodiment. FIG. 9 is an exploded perspective view of the discharge cover and the discharge valve assembly of FIG. 8. FIG. 10 is a cross-sectional view of the discharge cover and the discharge valve assembly of FIG. 8.

Referring to FIGS. 8 to 10, the linear compressor 100 according to this embodiment may include the discharge cover 200 coupled to a front portion of the frame 110 to define a discharge passage of the refrigerant discharged from the compression space P. The discharge cover 200 may include a cover body 200*a* that defines a discharge passage of the refrigerant discharged through the discharge valve 220, a frame coupling portion 201 that extends from the cover body 200*a* in a radial direction and is coupled to the frame 110, and a pipe connection portion 202 to discharge the refrigerant having passed through the discharge passage of the discharge body 200*a* to outside of the discharge cover 200. The frame coupling portion 201 may be disposed on or at a rear surface of the discharge cover 200, and the pipe connection portion 202 may be connected to the loop pipe 165.

The discharge valve assembly may be disposed on the discharge cover 200. The discharge valve assembly may include the discharge valve 220, the valve spring 230, the stopper 240, the spacer 250, and the spacer 260. The cover body 200*a* may include a plurality of steps 203 and 205 stepped forward from the frame coupling portion 201. The plurality of steps 203 and 205 may include a first step 203 recessed backward from the frame coupling portion 201, and a second step 205 further recessed from the first step 203 toward a resonance chamber 212.

The cover body 200*a* may further include a step connection portion 203*a* that extends inward from the first step 203 in the radial direction and connected to the second step 205. That is, in the cover body 200*a*, the first step 203 may extend inward in the radial direction, and then, may be further recessed backward to form the second step 205.

The first step 203 may have a discharge hole 204 to guide the refrigerant passing through the discharge passage of the cover body 200*a* into the pipe connection portion 202 to discharge the refrigerant from the discharge cover 200. The discharge hole 204 may pass through at least a portion of the first step 203. The refrigerant discharged through the discharge valve 220 may flow into the pipe connection portion 202 via the discharge hole 204.

The cover body 200*a* may further include the resonance chamber 212, which may be further recessed from the second step 205 to define a space to reduce pulsation of the refrigerant. A plurality of the resonance chamber 212 may be provided. At least a portion of the refrigerant discharged through the discharge valve 220 may flow into the space of the resonance chamber 212.

The cover body 200*a* may further include a seat 210 to partition the plurality of resonance chambers 212 to support the second spacer 260. The plurality of resonance chambers 212 may be further recessed forward from the seat 210 and be disposed to be spaced apart from each other by the seat 210.

A first guide groove 206 to guide at least a portion of the refrigerant discharged through the discharge valve 220 into the plurality of resonance chambers 212 may be defined in the cover body 200*a* as a "gas passage". The first guide groove 206 may extend forward from the step connection portion 203*a* toward the second step 205. At least a portion of each of the step connection portion 203*a* and the second step 205 may be cut to define the first guide groove 206.

A plurality of the first guide groove 206 may be provided to correspond to a number of resonance chambers 212. The plurality of first guide grooves 206 may be spaced apart from each other. As at least a portion of the refrigerant discharged through the opened discharge valve 220 may be introduced into the plurality of resonance chambers 212 along the first guide groove 206, pulsation generated when the refrigerant flows while the compressor operates may be reduced.

A second guide groove 207 to guide coupling of the stopper 240 may be defined in the cover body 200*a*. The second guide groove 207 may guide coupling of a guide protrusion of the stopper 240. At least a portion of each of the step connection portion 203*a* and the second step 205 may be cut to define the second guide groove 207.

A plurality of the second guide groove 207 may be provided to correspond to a number of guide protrusion 243 of the stopper 240. The plurality of second guide grooves 207 may be spaced apart from each other.

The discharge valve 220 may include a valve body 221 selectively attached to a front surface of the cylinder flange 125 of the cylinder 120, and a valve recess 223 recessed forward from the valve body 221. The valve recess 223 may be understood as an "interference prevention groove" to prevent at least a portion of the piston 130 from interfering with the discharge valve 220 while the piston 130 moves forward to compress the refrigerant. At least a portion of the piston 130 may include a coupling member to couple the suction valve 135 to the piston 130.

The discharge valve 220 may further include an insertion protrusion 222 that protrudes forward from the valve body 221 and is coupled to the valve spring 230. The insertion protrusion 222 may be coupled to an insertion hole 232 defined in the valve spring 230.

Each of the insertion protrusion 222 and the insertion hole 232 may have a noncircular cross-sectional shape. For example, the cross-sectional shape may be a polygonal shape. Thus, when the discharge valve 220 is opened or closed in a state in which the insertion protrusion 222 is inserted into the insertion hole 232, it may prevent the discharge valve 220 from rotating itself. As a result, it may prevent the discharge valve 220 from behaving unstably. In particular, if the gas bearing instead of the oil bearing is used in the linear compressor as described above, as there may be no lubrication for the discharge valve by oil, abrasion of the discharge valve due to the unstable behavior may be reduced.

The valve spring 230 may include a plate spring and have an approximately circular plate shape. In detail, the valve spring 230 may be coupled to a front portion of the discharge valve 220 to allow the discharge valve 220 to elastically move. The valve spring 230 may include a spring body 231 having a plurality of cutouts, and the insertion hole 232 defined in an approximately central portion of the spring body 231 and in which the insertion protrusion 222 of the discharge valve 220 may be inserted.

The plurality of cutouts may have a spiral shape. Also, the valve spring 230 may be elastically deformed by the plurality of cutouts.

The valve spring 230 may includes a spring recess 233 recessed from an outer circumferential surface of the spring body 231. The spring recess 233 may guide a position of the guide protrusion 243 of the stopper 240.

The stopper 240 may be disposed on or at a front side of the valve spring 230. In detail, the stopper 240 may include a stopper body 241 to restrict deformation of the valve spring 230 when the valve spring 230 is deformed. The stopper body 241 may have an approximately circular plate shape. When the valve spring 230 is deformed by a preset or predetermined degree or more, the stopper body 241 may be disposed at a position at which the stopper body 241 interferes with the valve spring 230.

The stopper 240 may further includes a valve avoidance groove 242 recessed forward from the stopper body 241. The valve avoidance groove 242 may be recessed from an approximately central portion of the stopper body 241 to prevent the stopper body 241 from interfering with the insertion protrusion 222 of the discharge valve 220. That is, when the insertion protrusion 222 moves forward while the discharge valve 220 is opened, the valve avoidance groove 242 may provide an interference avoidance space so that the stopper body 241 does not interfere with the insertion protrusion 222.

The stopper 240 may further include the guide protrusion 243 that protrudes backward from a rear surface of the stopper body 241 to guide coupling of the discharge cover 200. When the stopper 240 is coupled to the discharge cover 200, the guide protrusion 243 may move into the cover body 200*a* along the second guide groove 207.

The guide protrusion 243 may be coupled to the spring recess 233 of the valve spring 230, and a spacer groove 252 of the first spacer 250. Thus, the valve spring 230 may be stably coupled to the stopper 240 and the first spacer 250. For example, the stopper 240 may be press-fitted into and fixed to the second guide groove 207 in a state in which the guide protrusion 243 is coupled to the spring recess 233 and the spacer groove 252. Thus, the stopper 240 may be stably coupled to the discharge cover 200 without using a separate coupling member.

The first spacer 250 may be disposed between the valve spring 230 and the stopper 240 to space the valve 230 from the stopper 240. In detail, the first spacer 250 may include a spacer body 251 having an approximately ring shape, and a spacer groove 252 recessed from an outer circumferential surface of the spacer body 251 to guide a position of the guide protrusion 243 of the stopper 240.

The second spacer 260 may be seated on the seat 210 of the cover body 200*a* to support the stopper 240. That is, the second spacer 260 may be disposed between the seat 210 and the stopper 240 to prevent the stopper 240 from directly colliding with the discharge cover 200.

Figure 11:
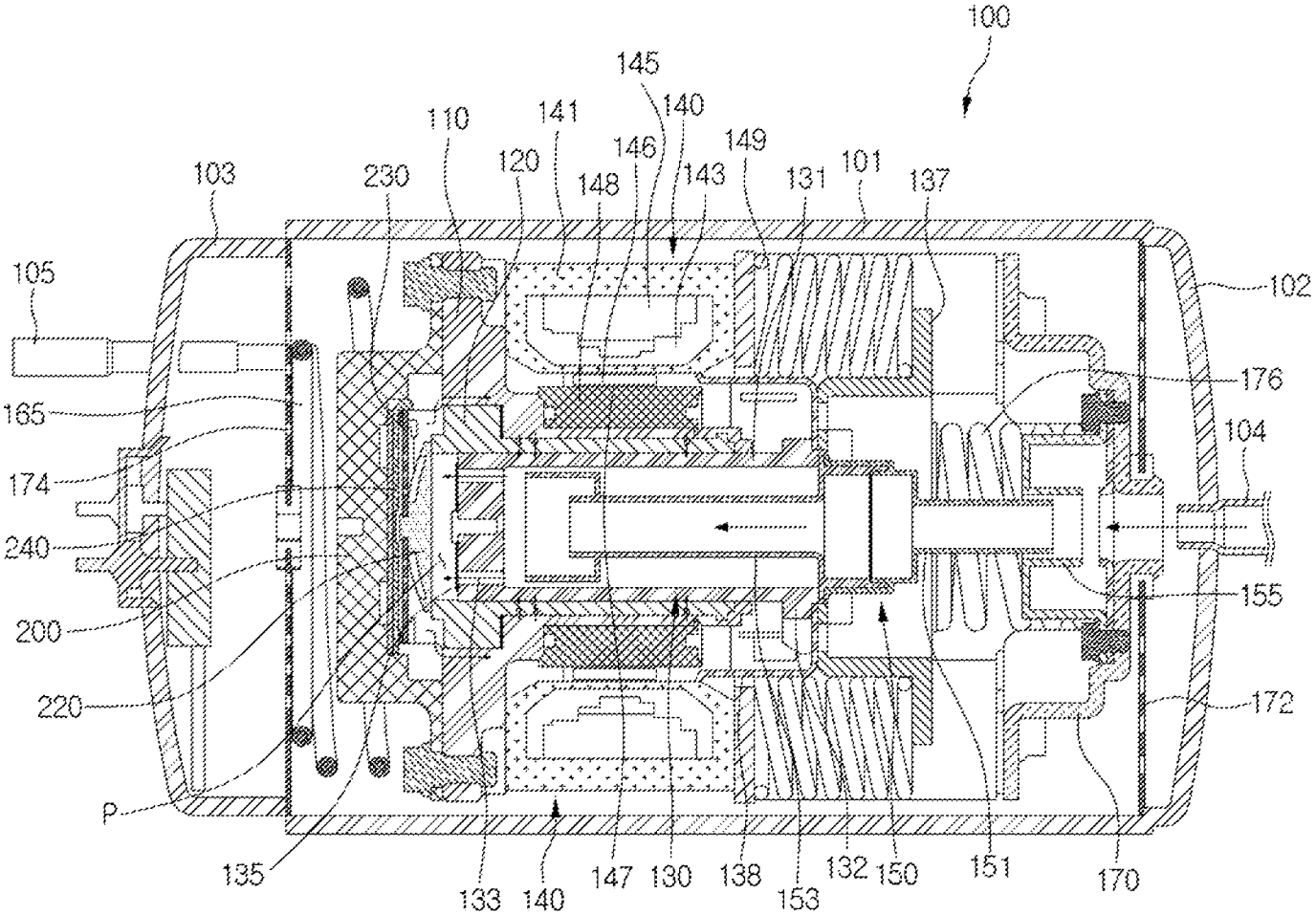
FIG. 11 is a cross-sectional view illustrating a refrigerant flow of the linear compressor according to an embodiment.

FIG. 11 is a cross-sectional view illustrating a refrigerant flow of the linear compressor according to an embodiment. Referring to FIG. 11, a refrigerant flow in the linear compressor according to an embodiment will be described herein below.

Referring to FIG. 11, the refrigerant may be introduced into the shell 101 through the suction inlet 104 and flow into the suction muffler 150 through the suction guide 155. The refrigerant may be introduced into the second muffler 153 via the first muffler 151 of the suction muffler 150 to flow into the piston 130. In this way, suction noise of the refrigerant may be reduced.

A foreign substance having a predetermined size (about 25 μm) or more, which is contained in the refrigerant, may be filtered while passing through the first filter 310 provided on the suction muffler 150. The refrigerant within the piston 130 after passing though the suction muffler 150 may be suctioned into the compression space P through the suction hole 133 when the suction valve 135 is opened.

When the refrigerant pressure in the compression space P is above the predetermined discharge pressure, the discharge valve 220 may be opened. Thus, the refrigerant may be discharged into the discharge space of the discharge cover 220 through the opened discharge valve 200, flow into the discharge outlet 105 through the loop pipe 165 coupled to the discharge cover 200, and be discharged outside of the compressor 100.

When the discharge valve 220 is opened, the valve spring 230 may be elastically deformed in a forward direction. In this way, the stopper 240 may prevent the valve spring 230 from being deformed by a preset or predetermined degree or more.

With this embodiment, when the linear compressor 100 operates at a high frequency, an opening degree of the discharge valve 220, that is, movement of the discharge valve 220 may increase. Thus, when the discharge valve 220 is closed, an impulse applied to the discharge valve 220 may increase, increasing abrasion of or to the discharge valve. When the gas bearing is applied without using oil, abrasion may increase.

Thus, in this embodiment, the discharge valve 220 may be elastically supported by the valve spring 230, and the stopper 240 may be disposed on or at one side of the valve spring 230 to restrict the opening degree of the discharge valve 220. At least a portion of the refrigerant within the discharge space of the discharge cover 200 may flow toward the outer circumferential surface of the cylinder body 121 via the space defined between the cylinder 120 and the frame 110, that is, the inner circumferential surface of the recess 117 of the frame 110 and the outer circumferential surface of the cylinder flange of the cylinder 120. The refrigerant may pass through the second filter 320 disposed between the seat surface 127 of the cylinder flange 125 and the seat 113 of the frame 110. In this way, a foreign substance having a predetermined size (about 2 μm) or more may be filtered. Also, oil in the refrigerant may be absorbed onto or into the second filter 320.

The refrigerant passing through the second filter 320 may be introduced into the plurality of gas inflows 122 defined in the outer circumferential surface of the cylinder body 121. While the refrigerant passes through the third filter 370 provided in the plurality of gas inflows 122, foreign substances having a predetermined size (about 1 μm) or more, which is contained in the refrigerant, may be filtered, and the oil contained in the refrigerant may be adsorbed.

The refrigerant passing through the third filter 330 may be introduced into the cylinder 120 through the nozzle(s) 123 and be disposed between the inner circumferential surface of the cylinder 120 and the outer circumferential surface of the piston 130 to space the piston 130 from the inner circumferential surface of the cylinder 120 (gas bearing). The inlet 123*a* of the nozzle 123 may have a diameter greater than a diameter of the outlet 123*b*. Thus, a refrigerant flow section area of the nozzle 123 may gradually decrease with respect to the flow direction of the refrigerant. For example, the inlet 123*a* may have a diameter two times greater than a diameter of the outlet 123*b*.

As described above, the high-pressure gas refrigerant may be bypassed within the cylinder 120 to serve as the gas bearing with respect to the piston 130, thereby reducing abrasion between the piston 130 and the cylinder 120. Also, as oil is not used for the bearing, friction loss due oil may not occur even though the compressor 100 operates at a high rate.

Also, as the plurality of filters are provided on or in the passage of the refrigerant flowing in the compressor 100, foreign substances contained in the refrigerant may be removed. Thus, the refrigerant acting as the gas bearing may be improved in reliability. Thus, the piston 130 or the cylinder 120 may be prevented from being worn by the foreign substances contained in the refrigerant.

Further, as the oil contained in the refrigerant may be removed by the plurality of filters, it may prevent friction loss due to oil from occurring. The first, second, and third filters 310, 320, and 330 may be referred to as a "refrigerant filter device" in that the filters 310, 320, and 330 filter the refrigerant that serves as the gas bearing.

Hereinafter, a description will be made according to another embodiment. As this embodiment is the same as the previous embodiment except for structures of a discharge cover and a discharge valve assembly, different parts therebetween will be described principally, and descriptions of the same or like parts will be denoted by the same reference numerals as the previous embodiment, and repetitive disclosure has been omitted.

Figure 12:
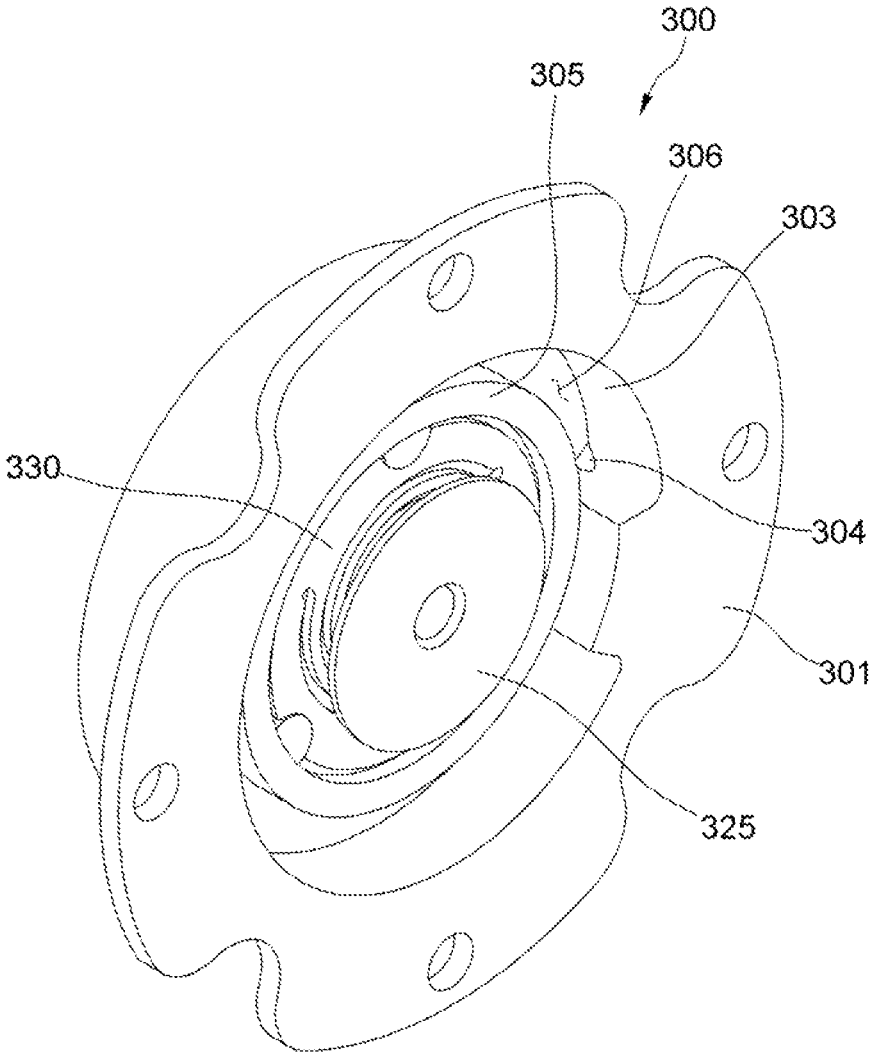
FIG. 12 is a perspective view of a discharge valve assembly coupled to a discharge cover according to another embodiment.
Figure 13:
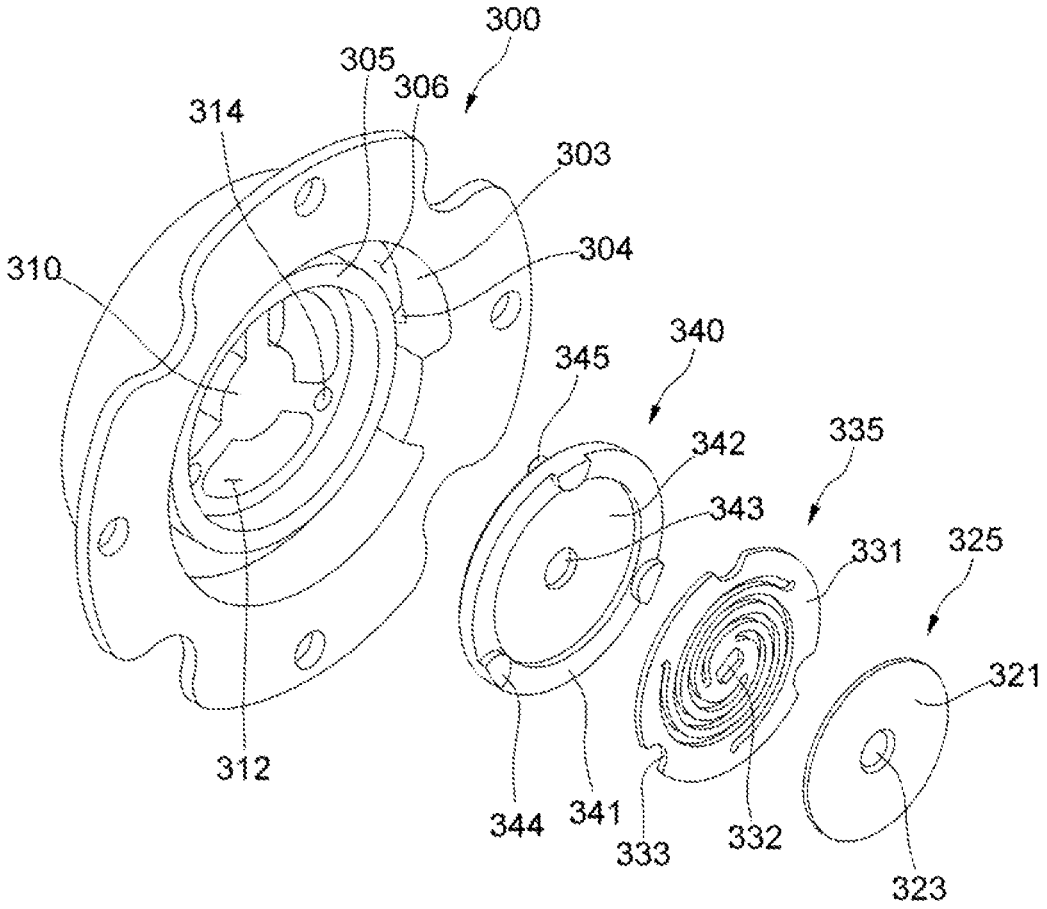
FIG. 13 is an exploded perspective view of the discharge cover and the discharge valve assembly of FIG. 12.
Figure 14:
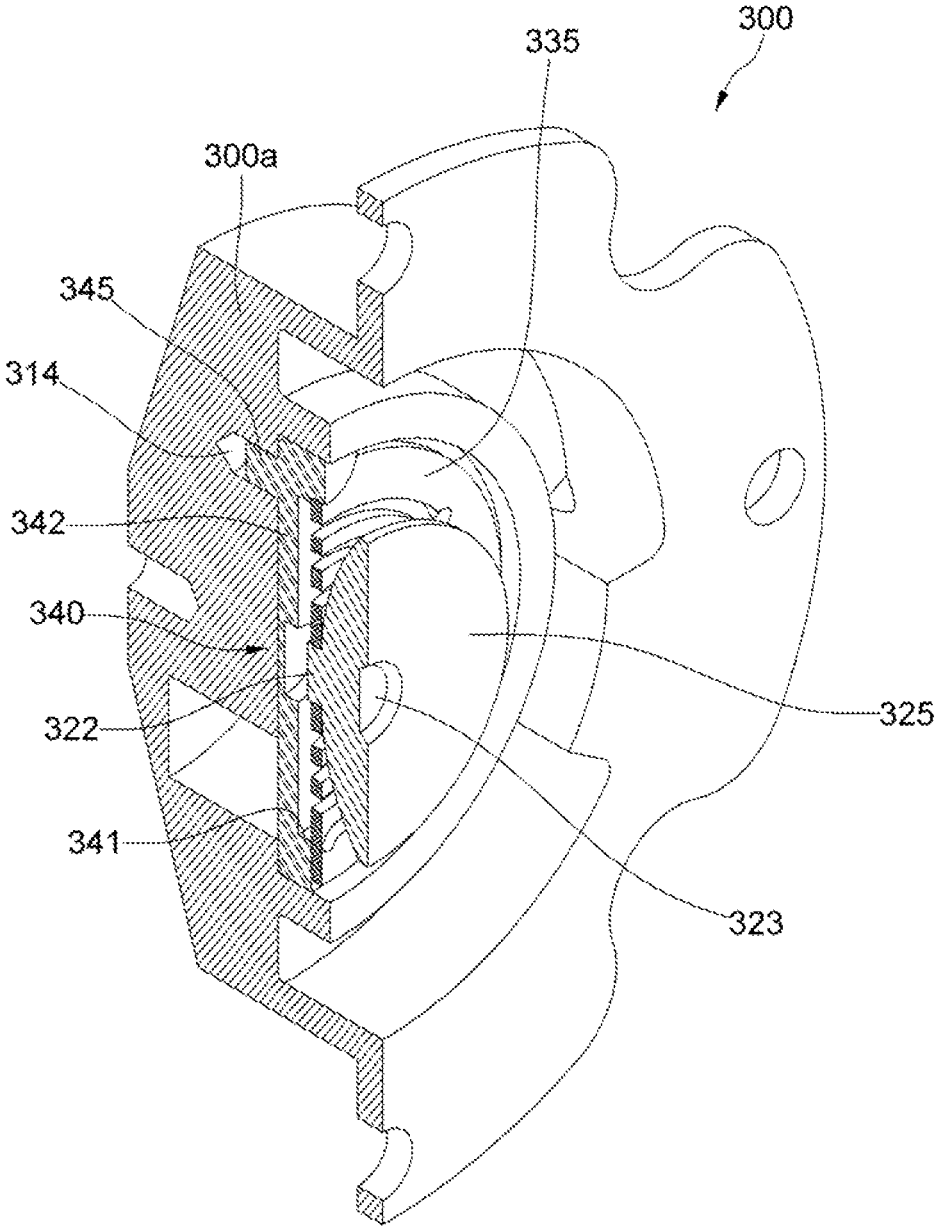
FIG. 14 is a cross-sectional view of the discharge cover and the discharge valve assembly of FIG. 12.

FIG. 12 is a perspective view of a discharge valve assembly coupled to a discharge cover according to another embodiment. FIG. 13 is an exploded perspective view of the discharge cover and the discharge valve assembly of FIG. 12. FIG. 14 is a cross-sectional view of the discharge cover and the discharge valve assembly of FIG. 12.

Referring to FIGS. 12 to 14, a discharge cover 300 according to this embodiment may include a cover body 300*a* that defines a discharge passage of a refrigerant discharged through a discharge valve 325, and a frame coupling portion 301 that extends backward from the cover body 300*a* and is coupled to frame 110. Also, although not shown, the discharge cover 300 may include a pipe connection portion 202 similar to that described with respect to the previous embodiment. The pipe connection portion 202 may be connected to loop pipe 165.

A discharge valve assembly may be disposed on the discharge cover 300. The discharge valve assembly may include the discharge valve 325, the valve spring 335, and a stopper 340. In detail, the cover body 300*a* of the discharge cover 300 may include a step 303 stepped forward from the frame coupling portion 301. The step 303 may have a discharge hole 304 to discharge the refrigerant outside of the discharge cover 300.

The cover body 300*a* may further include a passage formation portion 305 spaced inward from the step 303 in a radial direction. The passage formation portion 305 may have an approximately cylindrical shape. Also, the passage formation portion 305 may include a resonance chamber 312.

A discharge passage 306, through which the refrigerant discharged through the discharge valve 325 may flow, may defined between the step 303 and the passage formation portion 305. The refrigerant of the discharge passage 306 may be discharged outside of the discharge cover 300 through the discharge hole 304.

A seat 310, on which the stopper 340 may be seated, and a plurality of the resonance chamber 312 partitioned by the seat 310 may be disposed within the passage formation portion 305. The seat 310 may support a front surface of the stopper 340, and a coupling groove 314, in which a coupling protrusion 345 of the stopper 340 may be inserted may be defined in the seat 310. A plurality of the coupling groove 314 may be provided.

Each of the plurality of resonance chambers 312 may be recessed forward from the seat 210 to define a space in which the refrigerant may be received. The plurality of resonance chambers 312 may be defined at positions spaced apart from each other by the seat 310. The refrigerant discharged through the discharge valve 325 may be introduced into the plurality of resonance chambers 312 through a space defined between the passage formation portion 305 of the discharge cover 300 and the discharge valve assembly.

The discharge valve 325 may further include a valve body 321 selectively attached to a front surface of cylinder flange 125 of cylinder 120, a valve recess 323 recessed forward from the valve body 321, and an insertion protrusion 322 that protrudes backward from the valve body 321 and is coupled to the valve spring 335. Descriptions with respect to the discharge valve 325 will be derived from those of the discharge valve 220 described with respect to the previous embodiment.

The valve spring 335 may include a plate spring and have an approximately circular plate shape. In detail, the valve spring 335 may include a spring body 331 having a plurality of cutouts, an insertion hole 332 defined in an approximately central portion of the spring body 331 and in which the insertion protrusion 322 of the discharge valve 325 may be inserted, and a spring recess 333 recessed from an outer circumferential surface of the spring body 331. Descriptions with respect to the valve spring 335 will be derived from those of the valve spring 230 described with respect to the previous embodiment.

The stopper 340 may be disposed on or at a front side of the valve spring 335. In detail, the stopper 340 may include a stopper body 341 to restrict deformation of the valve spring 335 while the valve spring 335 is deformed, a stopper recess 342 recessed forward from the stopper body 341, and a valve avoidance groove 343 further recessed forward from an approximately central portion of the stopper recess 342.

The stopper body 341 may be seated on or at a rear surface of the valve spring 335. When the valve spring 335 is deformed by a preset or predetermined degree or more, the stopper recess 342 may be disposed at a position recessed forward from the stopper body 341 to interfere with the valve spring 335.

The valve avoidance groove 343 may prevent the stopper recess 342 from interfering with the insertion protrusion 322 of the discharge valve 325. That is, the valve avoidance groove 343 may provide an interference avoidance space to prevent interference with the insertion protrusion 322 when the discharge valve 325 is opened.

The stopper 340 may further include a guide protrusion 344 that protrudes backward from a rear surface of the stopper body 341 to guide coupling of the valve spring 335. The guide protrusion 344 may be coupled to the spring recess 333 of the valve spring 335.

The stopper 340 may further include a coupling protrusion 345 that protrudes forward from a front surface of the stopper recess 342. When the stopper 340 is coupled to the discharge cover 300, the coupling protrusion 345 may be coupled to the coupling groove 314 of the discharge cover 300.

Thus, as the stopper 340 supports a front portion of the valve spring 335, an opening degree of the discharge valve 325 may be restricted. As a result, when the discharge valve 325 is closed, an impulse may be reduced. Also, an assembly of the discharge valve 325 and the valve spring 335 may be stably installed on the discharge cover by the stopper 340.

Figure 15:
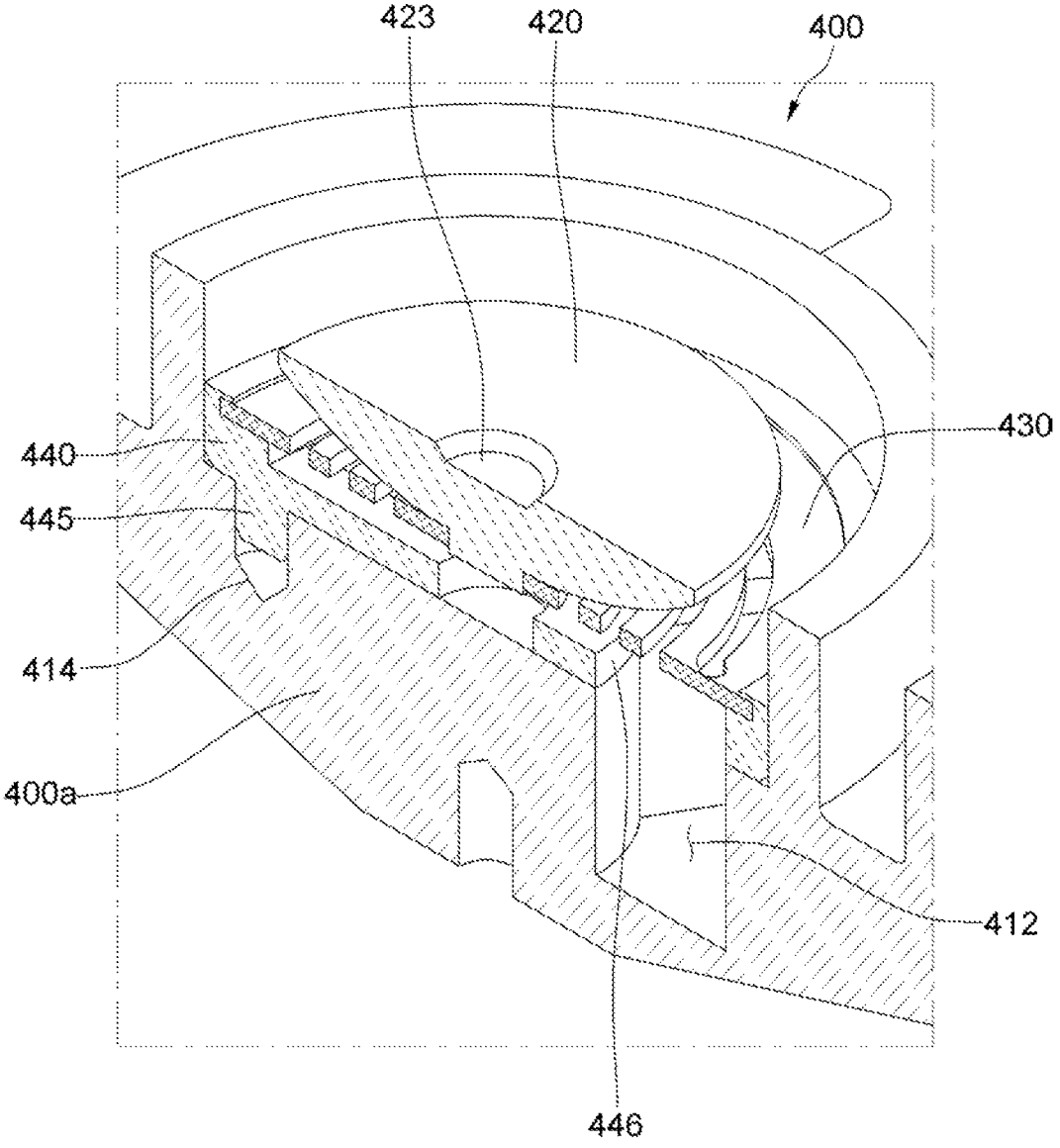
FIG. 15 is a perspective view of a discharge valve assembly coupled to a discharge cover according to still another embodiment.
Figure 16:
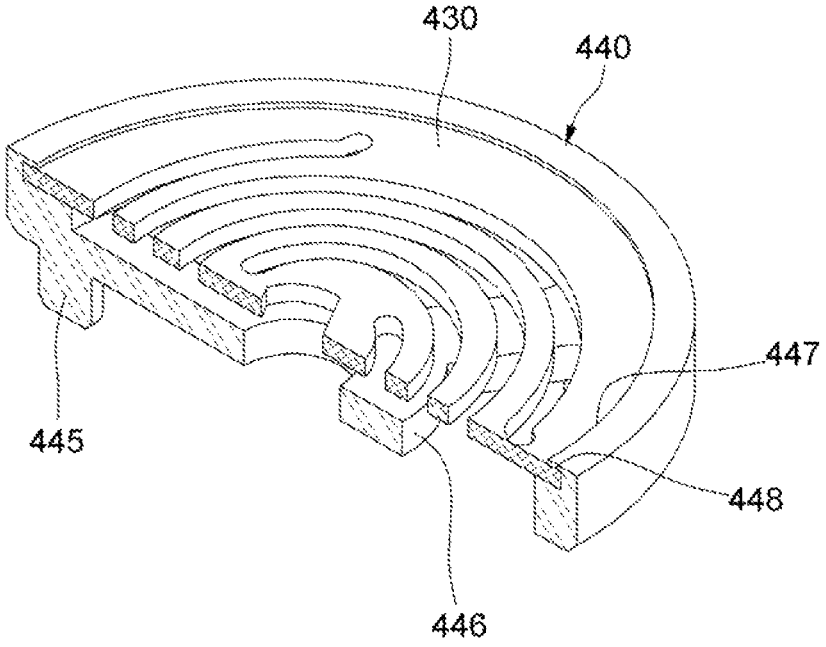
FIG. 16 is a cross-sectional view illustrating a state in which a valve spring and a stopper are coupled to each other according to an embodiment.

FIG. 15 is a perspective view of a discharge valve assembly coupled to a discharge cover according to still another embodiment. FIG. 16 is a cross-sectional view illustrating a state in which a valve spring and a stopper are coupled to each other according to an embodiment.

Referring to FIGS. 15 and 16, a discharge cover 400 according to this embodiment may include a cover body 400*a* that defines a resonance chamber 412. A coupling groove 414, in which a coupling protrusion 445 of a stopper 440 may be inserted, may be defined in the cover body 400*a*.

Descriptions with respect to the resonance chamber 412, the cover body 400*a*, the coupling protrusion 445, and the coupling groove 414 will be derived from those of the resonance chamber 312, the cover body 300*a*, the coupling protrusion 345, and the coupling groove 314, described with respect to the previous embodiment.

The discharge valve assembly may include a discharge valve 420, and a valve spring 430. The discharge valve 420 may include an insertion protrusion 422, and a valve recess 423. Descriptions with respect to the insertion protrusion 422 and the valve recess 423 will be derived from those of the insertion protrusion 322 and the valve recess 323 described with respect to the previous embodiment.

The stopper 440 may include a bent portion 447 bent to extend along a circumferential portion of the stopper 440, and an insertion portion 448 disposed within the bent portion 447 and in which an outer circumferential portion of the valve spring 430 may be inserted.

The outer circumferential portion of the valve spring 430 may be inserted inside a circumferential portion of the stopper 440 by the bent portion 447 and the insertion portion 448. For example, the stopper 440 may be manufactured through insert molding along the circumferential portion of the valve spring 430. Thus, as the stopper 440 and the valve spring 430 may be integrated with each other, vibration of the valve spring 430 while the compressor operates may be prevented.

A through hole 446 to guide the refrigerant so that at least a portion of the refrigerant discharged through the discharge valve 420 may be introduced into the resonance chamber 412 may be defined in the stopper 440. At least a portion of the stopper 440 may pass through the through hole 446. As the through hole 446 may be defined in the stopper 440, the refrigerant may be easily introduced into the resonance chamber 412.

Figure 17:
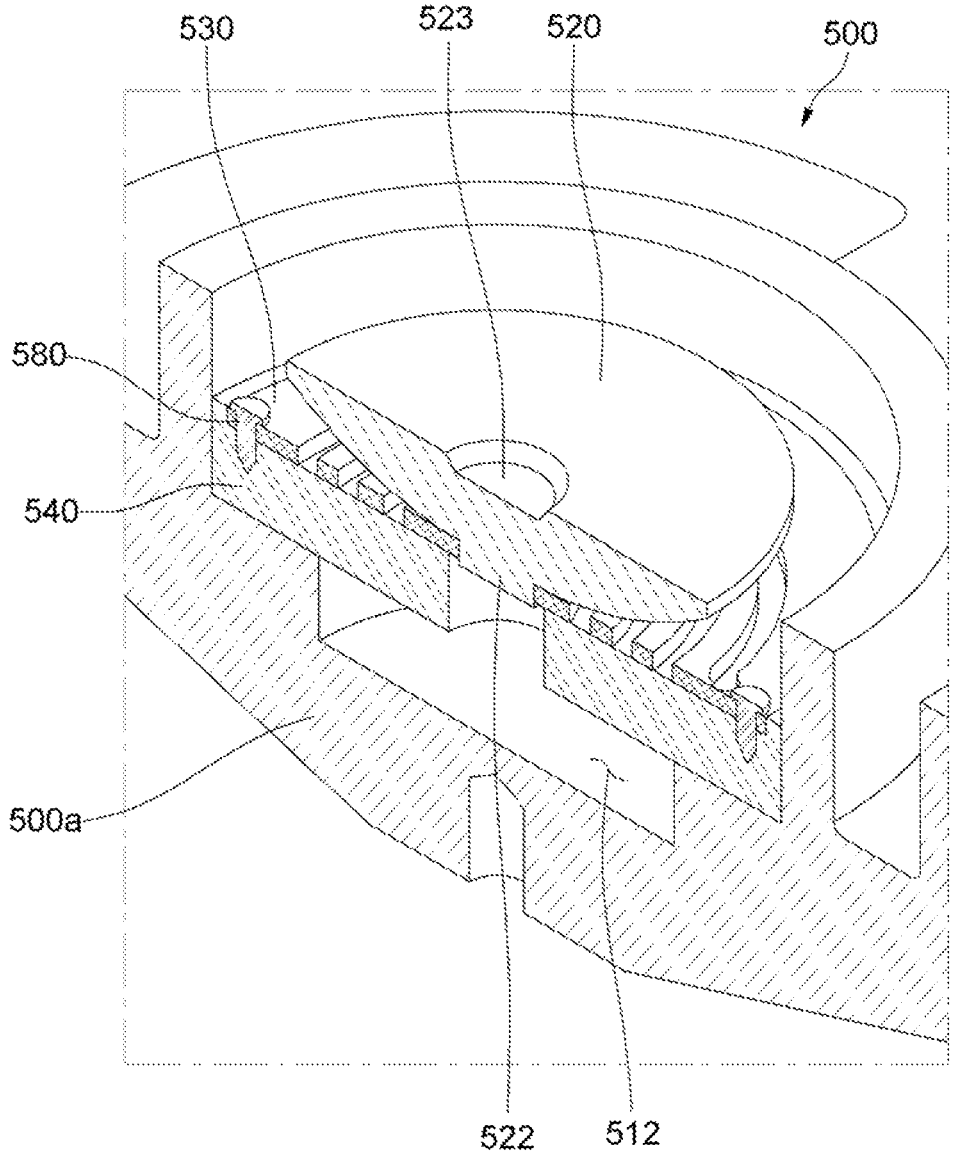
FIG. 17 is a cross-sectional view of a discharge valve assembly coupled to a discharge cover according to still another embodiment.

FIG. 17 is a cross-sectional view of a discharge valve assembly coupled to a discharge cover according to yet another embodiment. Referring to FIG. 17, a discharge cover 500 according to this embodiment may include a cover body 500*a* that defines a resonance chamber 512.

Descriptions with respect to the resonance chamber 512 and the cover body 500*a* will be derived from those of the resonance chamber 312 and the cover body 300*a* described with respect to the previous embodiment.

The discharge valve assembly may include a discharge valve 520, and a valve spring 530. The discharge valve 520 may include an insertion protrusion 522, and a valve recess 523. Descriptions with respect to the insertion protrusion 522 and the valve recess 523 will be derived from those of the insertion protrusion 322 and the valve recess 323 described with respect to the previous embodiment.

The discharge valve assembly according to this embodiment may further include a coupling member 580 to fix the valve spring 530 and the stopper 540. One or more coupling members 580 may be disposed along a circumferential portion of the valve spring 530 to extend from an upper portion of the valve spring 530 to the stopper 540. Thus, as the stopper 540 and the valve spring 530 may be firmly fixed by the coupling member 580, vibration of the valve spring 530 while the compressor operates may be prevented.

According to embodiments, the compressor including inner components may decrease in size to reduce a volume of a machine room of a refrigerator and increase an inner storage space of the refrigerant. Also, a drive frequency of the compressor may increase to prevent performance of the inner components from being deteriorated due to the decreasing size thereof. In addition, as the gas bearing is applied between the cylinder and the piston, friction force due to oil may be reduced.

Also, the discharge valve to selectively discharge the high-pressure gas compressed in the compression chamber may stably operate. In addition, an impulse occurring while the discharge valve operates may be reduced to reduce abrasion of the discharge valve. As a result, it may prevent foreign substances generated due to abrasion of the discharge valve from having an influence on the gas bearing.

Further, the opening degree of the discharge valve may be restricted by the stopper to reduce a time taken to close the discharge valve, thereby improving response for operating the discharge valve. Furthermore, the resonance chamber may be provided in the discharge cover to reduce pulsation of the discharge gas, thereby reducing noise.

Additionally, as the plurality of filtering device may be provided in the compressor, it may prevent foreign substances or oil contained in the compression gas (or discharge gas) introduced outside of the piston from being introduced into the nozzle of the cylinder. Therefore, as blocking of the nozzle of the cylinder may be prevented, the gas bearing effect may be effectively performed between the cylinder and the piston, and thus, abrasion of the cylinder and piston may be prevented.

Embodiments disclosed herein provide a linear compressor in which abrasion to a discharge valve may be reduced.

Embodiments disclosed herein provide a linear compressor that may include a shell including a discharge outlet; a cylinder provided in the shell to define a compression space for a refrigerant; a frame to fix the cylinder to the shell; a piston reciprocated within the cylinder in an axial direction; a discharge valve disposed on or at one side of the cylinder to selectively discharge the refrigerant compressed in the compression space; a discharge cover coupled to the frame, the discharge cover having resonance chambers to reduce pulsation of the refrigerant discharged through the discharge valve; a valve spring disposed on the discharge cover to provide a restoring force to the discharge valve; and a stopper coupled to the valve spring to restrict deformation of the valve spring. The discharge cover may include a cover body having a discharge hole, through which the refrigerant discharged through the discharge valve may be discharged to the outside of the discharge cover, and a guide passage defined in the cover body to guide at least a portion of the refrigerant discharged through the discharge valve into the resonance chambers.

The guide passage may include a first guide groove defined by recessing at least a portion of the cover body. The discharge cover may further include a frame coupling part or portion that extends outward from cover body in a radial direction and is coupled to the frame.

The cover body may include a first stepped part or step recessed from the frame coupling part, the first stepped part having a first discharge hole, and a second stepped part or step further recessed from the first stepped part toward the resonance chambers. The guide passage may be defined in the second stepped part.

The linear compressor may further include a second guide groove defined in the second stepped part to guide coupling of the stopper. The stopper may include a stopper body that supports the valve spring, and a guide protrusion that protrudes from the stopper body to move along the second guide groove.

The valve spring may include a plate spring. The valve spring may include a spring body including a plurality of cutoff parts or portions, and an insertion hole defined in the spring body and in which an insertion protrusion of the discharge valve may be coupled.

The linear compressor may further include a first spacer disposed between the valve spring and the stopper to space the valve spring from the stopper. The linear compressor may further include a second spacer disposed on the cover body to support the stopper.

The cover body may include a seat part or seat, on which the second spacer may be seated. The seat part may partition the plurality of resonance chambers.

Embodiments disclosed herein further may provide a linear compressor that may include a shell including a discharge outlet; a cylinder provided in the shell to define a compression space for a refrigerant; a frame to fix the cylinder to the shell; a piston reciprocated within the cylinder in an axial direction; a discharge valve disposed on or at one side of the cylinder to selectively discharge the refrigerant compressed in the compression space; a discharge cover having a resonance chamber to reduce pulsation of the refrigerant discharged through the discharge valve and a discharge hole to guide the discharged refrigerant into the discharge outlet of the shell; a valve spring disposed on the discharge cover to allow the discharge valve to elastically move; and a stopper coupled to the valve spring to restrict an opening degree of the discharge valve. The stopper may be coupled to an inside of the discharge cover.

The linear compressor may further include a spacer disposed between the stopper and the discharge cover to support the stopper. A guide groove may be defined in the discharge cover, and the stopper may be press-fitted into and fixed to the guide groove in a state in which the spacer is disposed on the stopper.

The discharge cover may include a seat part or seat, on which the stopper may be seated, and a coupling groove recessed from the seat part and in which a coupling protrusion of the stopper may be inserted.

The stopper may include an insertion part or portion, in which a circumferential portion of the valve spring may be inserted, and a through part or portion, through which at least a portion of the refrigerant may pass. The through part may guide the refrigerant discharged through the discharge valve into the resonance chamber.

The linear compressor may further include a coupling member to couple the stopper to the valve spring.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a shell comprising a discharge;

a cylinder provided in the shell to define a compression space for a refrigerant;

a frame to fix the cylinder to the shell;

a piston reciprocated within the cylinder in an axial direction;

a discharge valve disposed at one side of the cylinder to selectively discharge the refrigerant compressed in the compression space;

a discharge cover having at least one chamber to reduce pulsation of the refrigerant discharged through the discharge valve, and a discharge hole to guide the discharged refrigerant to the discharge of the shell;

a valve spring installed on the discharge cover to allow the discharge valve to elastically move;

a stopper coupled to the valve spring to restrict an opening degree of the discharge valve, wherein the stopper is installed inside of the discharge cover; and a first spacer provided between the stopper and the discharge cover to support the stopper, wherein the discharge cover comprises a seat, on which the first spacer is seated, the seat being configured to partition the at least one chamber into a plurality of chambers.

2. The linear compressor according to claim 1, wherein at least one guide groove is defined in the discharge cover, and wherein the stopper is press-fitted into the at least one guide groove.

3. The linear compressor according to claim 1, wherein the discharge cover comprises:

a seat, on which the stopper is seated; and at least one coupling groove recessed from the seat and into which a coupling protrusion of the stopper is inserted.

4. A linear compressor, comprising:

a shell;

a cylinder provided in the shell to define a compression space for a refrigerant;

a frame to fix the cylinder to the shell;

a piston reciprocated within the cylinder in an axial direction;

a discharge valve disposed at one end of the cylinder to selectively discharge the refrigerant compressed in the compression space;

a discharge cover including a cover body having a discharge hole through which the refrigerant discharged through the discharge valve flows, a frame coupling portion coupled to the frame and at least one chamber to reduce pulsation of the refrigerant discharged through the discharge valve;

a valve spring installed on the discharge cover to provide an elastic force to the discharge valve; and a stopper coupled to the valve spring to restrict deformation of the valve spring, wherein the cover body comprises:

a first step recessed from the frame coupling portion and having the discharge hole; and a second step further recessed from the first step toward the at least one chamber, the second step having at least one first guide groove to guide coupling of the stopper, and wherein the stopper comprises:

a stopper body that supports the valve spring; and at least one guide protrusion that protrudes from the stopper body to move along the at least first guide groove.

5. The linear compressor according to claim 4, wherein the discharge cover further comprises:

a guide passage defined in the cover body to guide at least a portion of the refrigerant discharged through the discharge valve into the at least one chamber.

6. The linear compressor according to claim 5, wherein the guide passage comprises a second guide groove defined by recessing at least a portion of the cover body.

7. The linear compressor according to claim 5, wherein the frame coupling portion extends outward from the cover body in a radial direction and is coupled to the frame.

8. The linear compressor according to claim 5, wherein the guide passage is defined in the second step.

9. The linear compressor according to claim 4, wherein the valve spring comprises a plate spring.

10. The linear compressor according to claim 9, wherein the valve spring comprises:

a spring body comprising a plurality of cutouts; and an insertion hole defined in the spring body and into which an insertion protrusion of the discharge valve is coupled.

11. The linear compressor according to claim 1, further comprising a first spacer disposed between the valve spring and the stopper to space the valve spring from the stopper.

12. The linear compressor according to claim 11, further comprising a second spacer installed between the stopper and the discharge cover to support the stopper.

13. The linear compressor according to claim 12, wherein the discharge cover comprises a seat, on which the second spacer is seated, and wherein the seat partitions the at least one chamber into a plurality of chambers.

14. A linear compressor, comprising:

a shell;

a cylinder provided in the shell to define a compression space for a refrigerant;

a frame to fix the cylinder to the shell;

a piston reciprocated within the cylinder in an axial direction;

a discharge valve disposed at one end of the cylinder to selectively discharge the refrigerant compressed in the compression space;

a discharge cover coupled to the frame, the discharge cover having at least one chamber to reduce pulsation of the refrigerant discharged through the discharge valve;

a valve spring installed on the discharge cover to provide an elastic force to the discharge valve;

a stopper coupled to the valve spring to restrict deformation of the valve spring; and a first spacer disposed between the valve spring and the stopper to space the valve spring from the stopper, the first spacer including a spacer body having a ring shape and a spacer groove recessed from an outer circumferential surface of the spacer body; and a second spacer installed between the stopper and the discharge cover to support the stopper.

15. The linear compressor according to claim 14, wherein the discharge cover comprises a seat, on which the second spacer is seated, and wherein the seat partitions the at least one chamber into a plurality of chambers.

* * * * *